US012728495B2

(12) United States Patent
Yamamoto et al.

(10) Patent No.: US 12,728,495 B2
(45) Date of Patent: Sep. 8, 2026

(54) POLISHING APPARATUS AND POLISHING METHOD

(71) Applicant: EBARA CORPORATION, Tokyo (JP)

(72) Inventors: Satoru Yamamoto, Tokyo (JP); Keisuke Uchiyama, Tokyo (JP); Mao Izawa, Tokyo (JP); Makoto Kashiwagi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 405 days.

(21) Appl. No.: 18/276,391

(22) PCT Filed: Jan. 14, 2022

(86) PCT No.: PCT/JP2022/001028
§ 371 (c)(1),
(2) Date: Aug. 8, 2023

(87) PCT Pub. No.: WO2022/172683
PCT Pub. Date: Aug. 18, 2022

(65) Prior Publication Data

US 2024/0109161 A1 Apr. 4, 2024

(30) Foreign Application Priority Data

Feb. 12, 2021 (JP) ..... 2021-021042

(51) Int. Cl.
*B24B 21/08* (2006.01)
*B24B 9/00* (2006.01)

(52) U.S. Cl.
CPC ..... *B24B 21/08* (2013.01); *B24B 9/00* (2013.01)

(58) Field of Classification Search
CPC ..... B24B 21/08; B24B 21/002; B24B 21/004; B24B 21/04; B24B 37/04; B24B 37/042; B24B 37/07; B24B 37/10
See application file for complete search history.

(56) References Cited

U.S. PATENT DOCUMENTS 4,628,640 A * 12/1986 Johannsen ..... B24B 21/14 451/303
4,656,790 A * 4/1987 Mukai ..... B24B 7/16 451/28

(Continued)

FOREIGN PATENT DOCUMENTS

JP H04-284266 A 10/1992
JP H05-151565 A 6/1993

(Continued)

OTHER PUBLICATIONS

International Patent Application No. PCT/JP2022/001028; Int'l Search Report; dated Mar. 29, 2022; 4 pages.

*Primary Examiner* — Joel D Crandall
(74) *Attorney, Agent, or Firm* — BakerHostetler

(57) ABSTRACT

The present invention relates to a polishing apparatus and a polishing method for polishing a flat portion of a substrate, such as a wafer. The polishing apparatus (100) includes: a substrate holder configured to hold a substrate (W) and rotate the substrate W; a polishing-tape feeding mechanism (141) configured to advance a polishing tape (3) in its longitudinal direction; and at least one polishing head (10) arranged near a flat portion of the substrate (W), wherein the polishing head (10) has a fluid pressing structure (12) configured to press the polishing tape (3) with fluid against the flat portion of the substrate, and the fluid pressing structure (12) has a fluid supply port (13) arranged so as to face a back surface of the polishing tape (3).

15 Claims, 15 Drawing Sheets

(56) References Cited

U.S. PATENT DOCUMENTS

| | | | | |
|---|---|---|---|---|
| 5,431,592 | A * | 7/1995 | Nakata | B24B 21/20 451/63 |
| 6,273,800 | B1 * | 8/2001 | Walker | B24B 37/12 451/299 |
| 7,014,529 | B1 * | 3/2006 | Kubota | B24B 37/015 451/7 |
| 7,367,873 | B2 * | 5/2008 | Ishii | B24B 21/002 451/6 |
| 7,682,225 | B2 * | 3/2010 | Hongo | B24B 37/02 451/446 |
| 7,758,404 | B1 * | 7/2010 | Ryder | B24B 9/065 451/526 |
| 8,152,598 | B2 * | 4/2012 | Fukushima | B24B 21/002 451/168 |
| 2017/0087684 | A1 * | 3/2017 | Hagan | B24D 11/00 |

FOREIGN PATENT DOCUMENTS

| | | | |
|---|---|---|---|
| JP | H07-108449 | A | 4/1995 |
| JP | H07-124853 | A | 5/1995 |
| JP | H11-232646 | A | 8/1999 |
| JP | 2002-245669 | A | 8/2002 |
| JP | 2019-077003 | A | 5/2019 |
| JP | 2019-107752 | A | 7/2019 |
| TW | 201139057 | A | 11/2011 |

* cited by examiner

POLISHING APPARATUS AND POLISHING METHOD

CROSS-REFERENCE TO RELATED APPLICATIONS

This application is a U.S. national phase application of International Patent Application No. PCT/JP2022/001028 filed Jan. 14, 2022, which claims the benefit of Japanese Patent Application No. 2021-021042 filed Feb. 12, 2021, which are incorporated by reference in their entireties for any and all purposes.

TECHNICAL FIELD

The present invention relates to a polishing apparatus and a polishing method for polishing a flat portion of a substrate, such as a wafer.

BACKGROUND ART

Devices, such as a memory circuit, a logic circuit, and an image sensor (e.g., a CMOS sensor) are becoming more highly integrated these days. In a process of forming such devices on a substrate, such as a wafer, foreign matter, such as fine particles or dust, or an unwanted film, may adhere to the substrate. Foreign matter adhering to a substrate can cause defects, such as a molding failure, or a damage of the device. Therefore, in order to enhance a reliability of the device, it is necessary to remove the foreign matter on the substrate.

There has been provided a polishing apparatus configured to polish a substrate using a polishing tool in order to remove foreign matter on the substrate, such as a wafer. Such a polishing apparatus is configured to polish a substrate by bringing a polishing tool into sliding contact with the substrate. The polishing apparatus polishes the substrate by pressing the polishing tool against the substrate with a polishing head.

CITATION LIST

Patent Literature

Patent document 1: Japanese laid-open patent publication No. 2019-77003

Patent document 2: Japanese laid-open patent publication No. 2019-107752

Patent document 3: Japanese laid-open patent publication No. H05-151565

Patent document 4: Japanese laid-open patent publication No. H07-108449

Patent document 5: Japanese laid-open patent publication No. H07-124853

SUMMARY OF INVENTION

Technical Problem

An example of the polishing apparatus is configured to polish a substrate by pressing a polishing tool, such as a polishing tape, against the substrate with a polishing head, while rotating the substrate and advancing the polishing tool in one direction. FIG. 21 is a diagram illustrating a problem of a conventional polishing head. A polishing head 310 presses a polishing tape 303 against a wafer W with a polishing blade 340 to polish the wafer W. At this time, the polishing tape 303 is advanced in a direction indicated by an arrow, so that dynamic friction force is generated between the polishing blade 340 and the polishing tape 303. Due to this dynamic friction force, a tension applied to a downstream side T1 of the polishing tape 303 in an advancing direction of the polishing tape 303 is larger than a tension applied to an upstream side T2 of the polishing tape 303. The polishing head 310 has a not-shown universal joint, and the polishing blade 340 is tilted by the tension on the polishing tape 303. Therefore, a pressing force against the polishing tape 303 at a pressing point P1 located in the downstream side in the advancing direction of the polishing tape 303 is smaller than that at a pressing point P2 located in the upstream side. As a result, the wafer W cannot be uniformly polished.

One possible solution to the above problem is to change a material of the polishing blade 340 in order to reduce a friction coefficient, but the dynamic friction force cannot be reduced to zero. Another possible solution is to adjust a tilt angle of the polishing blade 340 so as to equalize pressing forces at the pressing point P1 and the pressing point P2 without applying the universal joint to the polishing head 310. However, it is difficult to adjust the tilt angle of the polishing head 310 according to a change in tension applied to the polishing tape 303.

It is therefore an object of the present invention to provide a polishing apparatus and a polishing method capable of uniformly polishing a flat portion of a substrate without affecting pressing force of a polishing head due to dynamic friction force generated between the polishing head and a polishing tape.

Solution to Problem

In an embodiment, there is provided a polishing apparatus for polishing a flat portion of a substrate, comprising: a substrate holder configured to hold a substrate and rotate the substrate; a polishing-tape feeding mechanism configured to advance a polishing tape in its longitudinal direction; and at least one polishing head arranged near a flat portion of the substrate, wherein the polishing head has a fluid pressing structure configured to press the polishing tape with fluid against the flat portion of the substrate, and the fluid pressing structure has a fluid supply port arranged so as to face a back surface of the polishing tape.

In an embodiment, the fluid pressing structure comprises a slit nozzle having the fluid supply port in a slit shape.

In an embodiment, the fluid pressing structure comprises an area pad having a pressing surface and the fluid supply port, the pressing surface having a recess formed in the center of the pressing surface, and the fluid supply port being located in the recess.

In an embodiment, the fluid comprises a fluid mixture of gas and liquid.

In an embodiment, a proportion of the gas in the fluid mixture is higher than a proportion of the liquid in the fluid mixture.

In an embodiment, the flat portion of the substrate comprises an edge portion located in a periphery of the substrate, and the fluid pressing structure has an arc shape having a curvature substantially the same as a curvature of a peripheral shape of the substrate.

In an embodiment, there is provided a polishing method for polishing a flat portion of a substrate, comprising: holding a substrate and rotating the substrate by a substrate holder; and advancing a polishing tape in its longitudinal direction by a polishing-tape feeding mechanism, while pressing the polishing tape with fluid against a flat portion of the substrate by supplying the fluid from a fluid supply port formed in a fluid pressing structure of a polishing head toward a back surface of the polishing tape.

In an embodiment, the fluid pressing structure comprises a slit nozzle having the fluid supply port in a slit shape.

In an embodiment, the fluid pressing structure comprises an area pad having a pressing surface and the fluid supply port, the pressing surface having a recess formed in the center of the pressing surface, and the fluid supply port being located in the recess.

In an embodiment, the fluid comprises a fluid mixture of gas and liquid.

In an embodiment, a proportion of the gas in the fluid mixture is higher than a proportion of the liquid in the fluid mixture.

In an embodiment, the flat portion of the substrate comprises an edge portion located in a periphery of the substrate, and the fluid pressing structure has an arc shape having a curvature substantially the same as a curvature of a peripheral shape of the substrate.

Advantageous Effects of Invention

According to the present invention, pressing the polishing head against the polishing tape with the fluid can uniformly polish the flat portion of the substrate without generating dynamic friction force between the polishing head and the polishing tape.

Further, according to the present invention, friction heat generated between the substrate and the polishing tape during polishing can be cooled by the fluid, so that a polishing rate can be improved.

Furthermore, the fluid flows to the polishing point of the substrate, so that polishing debris can be removed from a substrate surface.

DESCRIPTION OF EMBODIMENTS

Hereinafter, embodiments of the present invention will be described with reference to the drawings.

Figure 1:
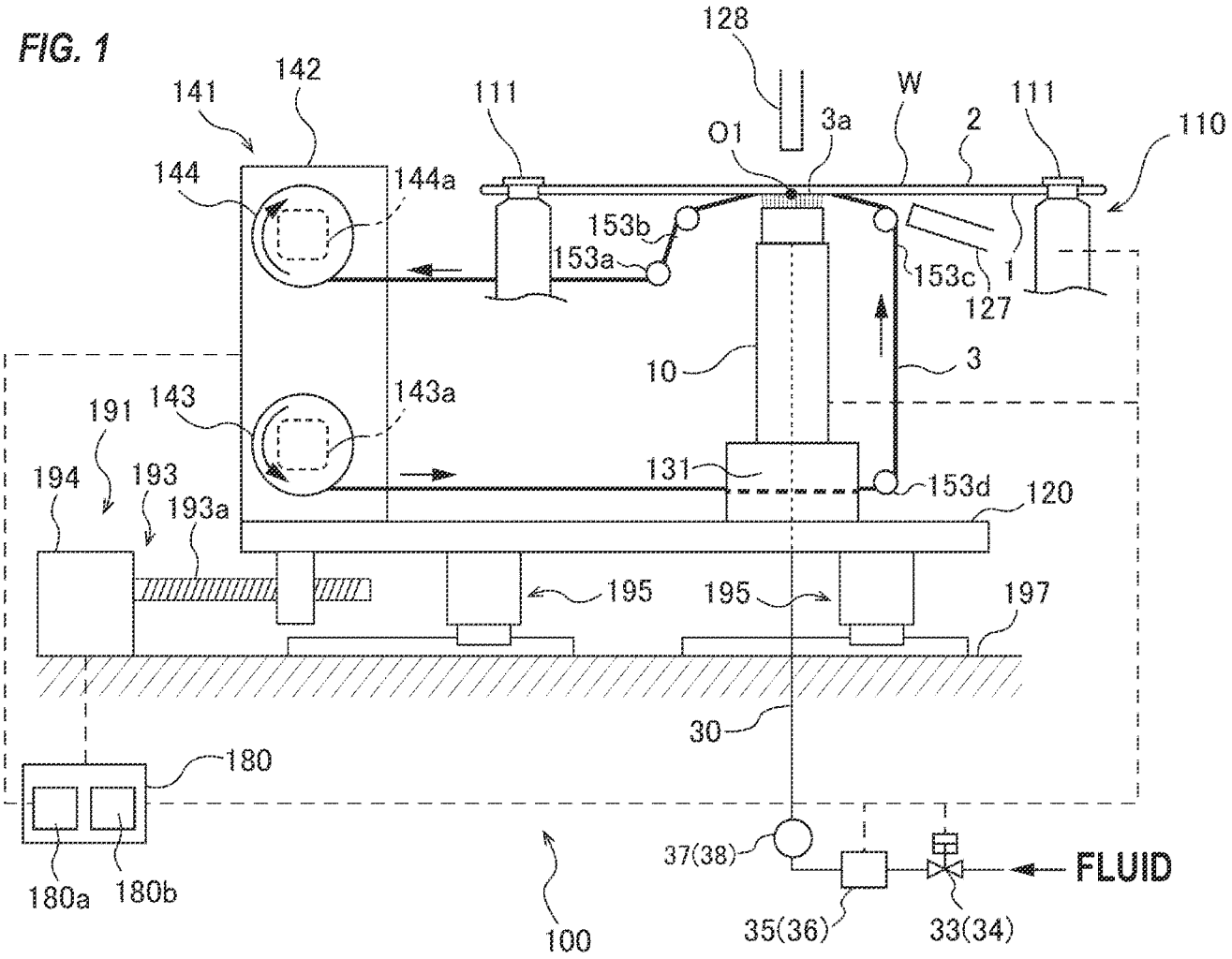
FIG. 1 is a schematic diagram showing an embodiment of a polishing apparatus.

FIG. 1 is a schematic diagram showing an embodiment of a polishing apparatus. A polishing apparatus 100 shown in FIG. 1 includes a substrate holder 110 configured to hold a wafer W, which is an example of a substrate, and rotate the wafer W about its own axis, a polishing head 10 configured to press a polishing tape 3 as a polishing tool with fluid against a first surface 1 of the wafer W held by the substrate holder 110 to polish the first surface 1 of the wafer W, and a polishing-tape feeding mechanism 141 configured to feed the polishing tape 3 to the polishing head 10.

The substrate holder 110 includes a plurality of rollers 111 which can contact a periphery of the wafer W, and a roller rotating mechanism (not shown) configured to rotate the plurality of rollers 111 about their respective own axes. The polishing head 10 is disposed below the wafer W held by the substrate holder 110. In FIG. 1, depiction of a part of the substrate holder 110 is omitted. The substrate holder 110 of this embodiment includes four rollers 111 (two of which are not shown).

In this embodiment, the first surface 1 of the wafer W is a back surface of the wafer W on which no device is formed or device is not to be formed, i.e., a non-device surface. A second surface 2 of the wafer W, which is opposite the first surface 1, is a surface on which devices are formed or devices are to be formed, i.e., a device surface. In this embodiment, the wafer W is held by the substrate holder 110 horizontally with the first surface 1 facing downward.

The roller rotating mechanism is configured to rotate the four rollers 111 at the same speed in the same direction. During polishing of the first surface 1 of the wafer W, the periphery of the wafer W is held by the rollers 111. The wafer W is held horizontally, and is rotated about its own axis by the rotations of the rollers 111. During the polishing of the first surface 1 of the wafer W, the four rollers 111 rotate about their respective own axes, while positions of the rollers 111 themselves remain stationary.

As shown in FIG. 1, a rinsing-liquid supply nozzle 127 configured to supply a rinsing liquid (e.g., pure water or an alkaline chemical liquid) onto the first surface 1 of the wafer W is disposed below the wafer W held by the substrate holder 110. The rinsing-liquid supply nozzle 127 is coupled to a not-shown rinsing-liquid supply source. The rinsing-liquid supply nozzle 127 is oriented toward a processing point of the first surface 1 of the wafer W. In FIG. 1, one rinsing-liquid supply nozzle 127 is disposed, while in one embodiment, a plurality of rinsing-liquid supply nozzles 127 may be disposed so as to be oriented toward the processing point of the first surface 1 of the wafer W and/or area(s) other than the processing point. The rinsing liquid supplied from the rinsing-liquid supply nozzle 127 to the processing point of the first surface 1 of the wafer W can remove polishing debris from the first surface 1 of the wafer W. At this time, the rinsing liquid may preferably be supplied to an upstream side of the polishing head 10 in a rotating direction of the wafer W. In addition, the rinsing liquid supplied to area(s) other than the processing point can prevent the wafer W from drying.

A protective-liquid supply nozzle 128 configured to supply a protective liquid (e.g., pure water) onto the second surface 2 of the wafer W is disposed above the wafer W held by the substrate holder 110. The protective-liquid supply nozzle 128 is coupled to a not-shown protective-liquid supply source. The protective-liquid supply nozzle 128 is oriented toward the center of the second surface 2 of the wafer W. The protective liquid is supplied from the protective-liquid supply nozzle 128 to the center of the second surface 2 of the wafer W, and the protective liquid spreads over the second surface 2 of the wafer W by centrifugal force. The protective liquid prevents the rinsing liquid containing polishing debris and foreign matter generated in the polishing of the wafer W from contacting the second surface 2 of the wafer W. As a result, the second surface 2 of the wafer W can be kept clean.

The polishing head 10 is supported by a supporting member 131, and the supporting member 131 is fixed to a movable plate 120. Therefore, the entire polishing head 10 can move together with the movable plate 120. The supporting member 131 has a not-shown through-hole, and the polishing tape 3 extends through this through-hole.

The polishing head 10 is configured to press the polishing tape 3 with fluid against the first surface 1 of the wafer W. The polishing head 10 is coupled to a fluid supply line 30, and the fluid is supplied from a not-shown fluid supply source to the polishing head 10. Details of the polishing head 10 will be described later.

The polishing-tape feeding mechanism 141 includes a tape feeding reel 143 configured to feed the polishing tape 3, and a tape take-up reel 144 configured to collect the polishing tape 3. The tape feeding reel 143 and the tape take-up reel 144 are coupled to tension motors 143*a* and 144*a*, respectively. The tension motors 143*a* and 144*a* are fixed to a reel base 142. The reel base 142 is fixed to the movable plate 120, so that the entire polishing-tape feeding mechanism 141 can move together with the movable plate 120.

The polishing tape 3 is advanced or fed from the tape feeding reel 143 to the tape take-up reel 144 via the polishing head 10 in a direction indicated by arrows by rotating the tape take-up reel 144 in a direction indicated by an arrow. The polishing tape 3 is fed to a position over the polishing head 10 such that a polishing surface 3*a* of the polishing tape 3 faces the first surface 1 of the wafer W. The tension motor 143*a* can apply tension to the polishing tape 3 by applying a predetermined torque to the tape feeding reel 143. The tension motor 144*a* is controlled such that the polishing tape 3 is advanced at a constant speed. An advancing speed of the polishing tape 3 can be changed by changing a rotating speed of the tape take-up reel 144. In one embodiment, the advancing direction of the polishing tape 3 may be opposite to the direction indicated by the arrow shown in FIG. 1 (arrangements of the tape feeding reel 143 and the tape take-up reel 144 may be interchanged). A tape advancing device may be provided in addition to the tape take-up reel 144. In this case, the tension motor 144*a* coupled to the tape take-up reel 144 can apply tension to the polishing tape 3 by applying a predetermined torque to the tape take-up reel 144.

The polishing apparatus 100 further includes a plurality of guide rollers 153*a*, 153*b*, 153*c*, and 153*d* configured to support the polishing tape 3. The polishing tape 3 is guided so as to surround the polishing head 10 by these guide rollers 153*a*, 153*b*, 153*c*, and 153*d*. The polishing head 10 polishes the first surface 1 of the wafer W by pressing the polishing tape 3 from its back side with the fluid against the first surface 1 of the wafer W. The guide rollers 153*b* and 153*c* arranged above the polishing head 10 guide the polishing tape 3 such that the polishing tape 3 advances in a direction parallel to the first surface 1 of the wafer W. The guide rollers 153*a*, 153*b*, 153*c*, and 153*d* are fixed to a not-shown holding member, and this holding member is fixed to the movable plate 120.

In order to bring the polishing tape 3 into contact with a region ranging from the center O1 to an outermost portion of the first surface 1 of the wafer W, the polishing apparatus 100 of this embodiment includes a polishing-head moving mechanism 191 configured to translate the polishing head 10 relative to the substrate holder 110. The polishing-head moving mechanism 191 is configured to move the polishing head 10 between the center O1 of the first surface 1 of the wafer W and the outermost portion of the first surface 1.

A plurality of linear-motion guides 195 are fixed to a lower surface of the movable plate 120, and the movable plate 120 is supported by the plurality of linear-motion guides 195. The plurality of linear-motion guides 195 are disposed on a mounting surface 197. The movable plate 120 is moved by the polishing-head moving mechanism 191, and the linear-motion guide 195 restricts the movement of the movable plate 120 to a linear motion in a radial direction of the wafer W.

The polishing-head moving mechanism 191 includes a ball-screw mechanism 193 and a motor 194 configured to drive the ball-screw mechanism 193. A servo motor can be used as the motor 194. The movable plate 120 is coupled to a screw shaft 193*a* of the ball-screw mechanism 193. When the polishing-head moving mechanism 191 operates, the polishing head 10, the polishing-tape feeding mechanism 141, and the guide rollers 153*a*, 153*b*, 153*c*, and 153*d* are moved in the radial direction of the wafer W relative to the substrate holder 110.

During the polishing of the wafer W, the polishing-head moving mechanism 191 moves the polishing head 10 between the center O1 of the first surface 1 of the wafer W and the outermost portion of the first surface 1. The polishing apparatus 100 further includes an operation controller 180 configured to control operations of each component of the polishing apparatus 100. The polishing-head moving mechanism 191 is electrically connected to the operation controller 180, so that operations of the polishing-head moving mechanism 191 are controlled by the operation controller 180. When the polishing-head moving mechanism 191 operates, the polishing head 10, the polishing-tape feeding mechanism 141, and the guide rollers 153*a*, 153*b*, 153*c*, and 153*d* are moved together.

During the polishing of the first surface 1 of the wafer W, the positions of the rollers 111 themselves remain stationary, and the rollers 111 are arranged at positions where the rollers 111 do not contact the polishing head 10 when the polishing head 10 moves from the center side of the wafer W to the outer side of the wafer W. Therefore, the polishing tape 3 can polish the entire first surface 1 including the outermost portion of the wafer W.

Figure 2:
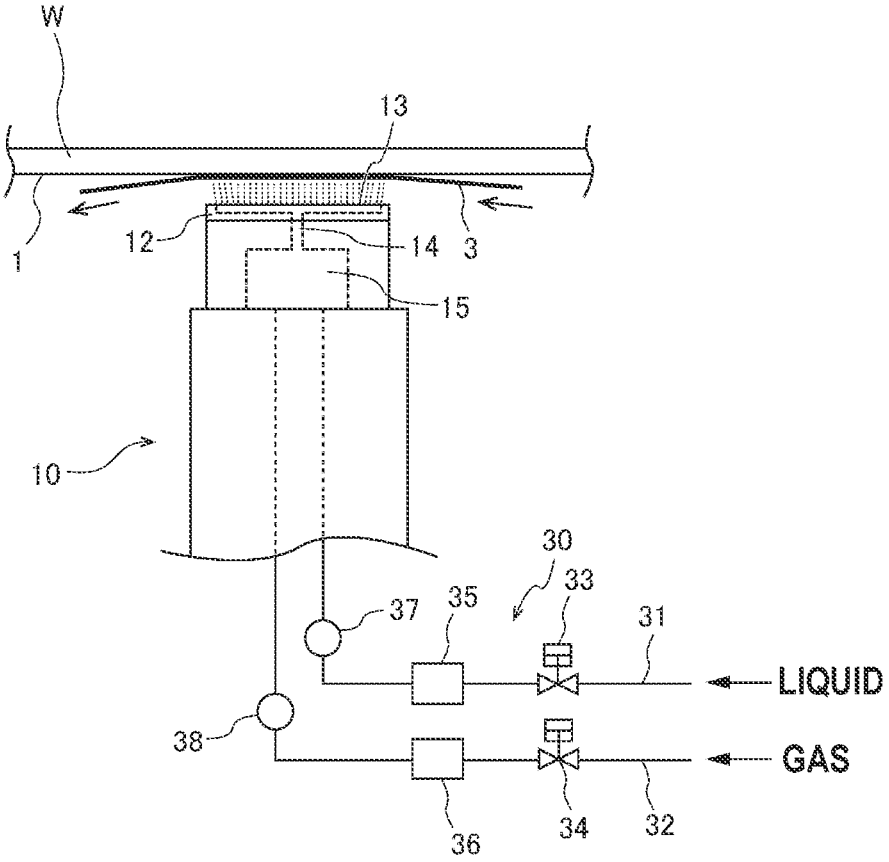
FIG. 2 is a schematic diagram showing an embodiment of a polishing head.
Figure 3:
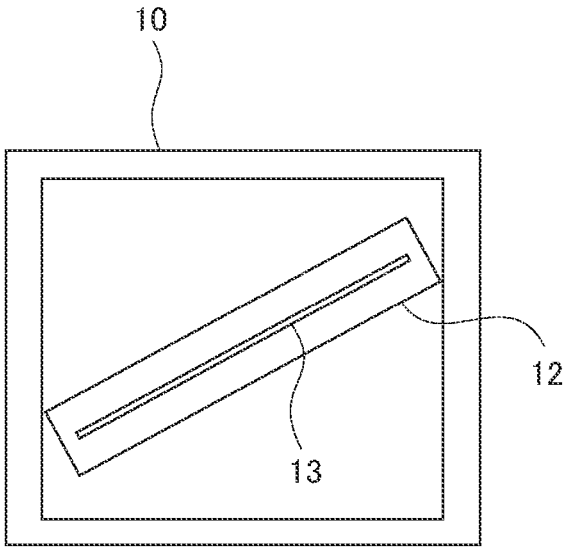
FIG. 3 is a plan view of the polishing head shown in FIG. 2.

FIG. 2 is a schematic diagram showing an embodiment of the polishing head 10. FIG. 3 is a plan view of the polishing head 10 shown in FIG. 2. FIG. 2 illustrates the polishing tape 3 when being pressed against the first surface 1 of the wafer W with the fluid supplied from the polishing head 10. The polishing tape 3 is advanced at a predetermined speed in a direction indicated by arrows. The polishing head 10 is disposed below the polishing tape 3, and the polishing tape 3 and the polishing head 10 are separated from each other.

The polishing head 10 is coupled to the fluid supply line 30, and the fluid is supplied from the not-shown fluid supply source to the polishing head 10. More specifically, the fluid supply line 30 has a liquid supply line 31 to which a liquid (e.g., pure water, carbonated water, alkaline chemical liquid, etc.) is supplied from a not-shown liquid supply source, and a gas supply line 32 to which a gas (e.g., dry air, inert gas, etc.) is supplied from a not-shown gas supply source. In one embodiment, the fluid supply line 30 may have either the liquid supply line 31 or the gas supply line 32.

The polishing head 10 has a fluid pressing structure 12, a flow passage 14, and a fluid mixing chamber 15. In the polishing head 10 of this embodiment, the fluid pressing structure 12 is constituted of a slit nozzle. The fluid pressing structure 12 is arranged in an upper portion of the polishing head 10. As shown in FIG. 3, a slit-shaped fluid supply port 13 is formed in the fluid pressing structure 12, and the fluid supply port 13 extends in a straight line in a longitudinal direction of the fluid pressing structure 12. The fluid pressing structure 12 and the fluid supply port 13 are arranged obliquely with respect to the polishing head 10 when the polishing head 10 is viewed from above.

The flow passage 14 communicates with the fluid supply port 13 and the fluid mixing chamber 15. The fluid mixing chamber 15 is coupled to the fluid supply line 30, i.e., the liquid supply line 31 and the gas supply line 32. The liquid flowing through the liquid supply line 31 and the gas flowing through the gas supply line 32 are mixed in the fluid mixing chamber 15 to form a fluid mixture. This fluid mixture flows through the flow passage 14, and is supplied as a two-fluid jet from the fluid supply port 13 toward a back surface of the polishing tape 3. The fluid supply port 13 is arranged so as to face the back surface of the polishing tape 3, so that the polishing tape 3 can be pressed against the first surface 1 of the wafer W by the fluid mixture (two-fluid jet) supplied from the fluid supply port 13.

The liquid supply line 31 is provided with a liquid supply valve 33 configured to open and close a flow passage of the liquid supply line 31, a flow-rate controller 35 configured to regulate a flow rate of the liquid flowing through the liquid supply line 31, and a flow meter 37 configured to measure the flow rate of the liquid flowing through the liquid supply line 31. The liquid supply valve 33 is arranged upstream of the flow-rate controller 35 and the flow meter 37 in a flowing direction of the liquid. An example of the flow-rate controller 35 includes a flow-rate control valve or a mass flow-rate controller. A pressure sensor (not shown) may be provided between the flow meter 37 and the fluid mixing chamber 15.

The gas supply line 32 is provided with a gas supply valve 34 configured to open and close a flow passage of the gas supply line 32, a flow-rate controller 36 configured to regulate a flow rate of the gas flowing through the gas supply line 32, and a flow meter 38 configured to measure the flow rate of the gas flowing through the gas supply line 32. The gas supply valve 34 is arranged upstream of the flow-rate controller 36 and the flow meter 38 in a flowing direction of the gas. An example of the flow-rate controller 36 includes a flow-rate control valve or a mass flow-rate controller. A pressure controller configured to regulate a pressure of the gas flowing through the gas supply line 32 may be provided instead of the flow-rate controller 36. An example of the pressure controller includes an electro-pneumatic regulator. A pressure gauge configured to measure the pressure of the gas flowing through the gas supply line 32 may be provided instead of the flow meter 38. A flow meter and a pressure gauge may be provided together between the flow-rate controller 36 (or the pressure controller) and the fluid mixing chamber 15.

In one embodiment, a proportion of the gas in the fluid mixture is higher than a proportion of the liquid in the fluid mixture. In general, when comparing the same amount of liquid (e.g., pure water, carbonated water, chemical liquid, etc.) with gas (e.g., dry air, inert gas, etc.), the gas is less expensive. Therefore, cost can be reduced by making the proportion of the gas in the fluid mixture higher than the proportion of the liquid. The proportions of the gas and the liquid in the fluid mixture can be regulated by the flow-rate controller 35 and the flow-rate controller 36 (or the pressure controller).

In this embodiment, the liquid and the gas are mixed in the fluid mixing chamber 15 in the polishing head 10 to produce the fluid mixture, while in one embodiment, the fluid supply line 30 through which a fluid mixture mixed in advance flows may communicate with the flow passage 14 without passing through the fluid mixing chamber 15, and the fluid mixture may be directly supplied to the fluid pressing structure 12. In one embodiment, one of the liquid supply line 31 and the gas supply line 32 may communicate with the flow passage 14 without passing through the fluid mixing chamber 15, and only one of the liquid and the gas may be supplied to the fluid pressing structure 12. In both cases, the polishing head 10 can supply the fluid from the fluid supply port 13 toward the back surface of the polishing tape 3.

Figure 4:
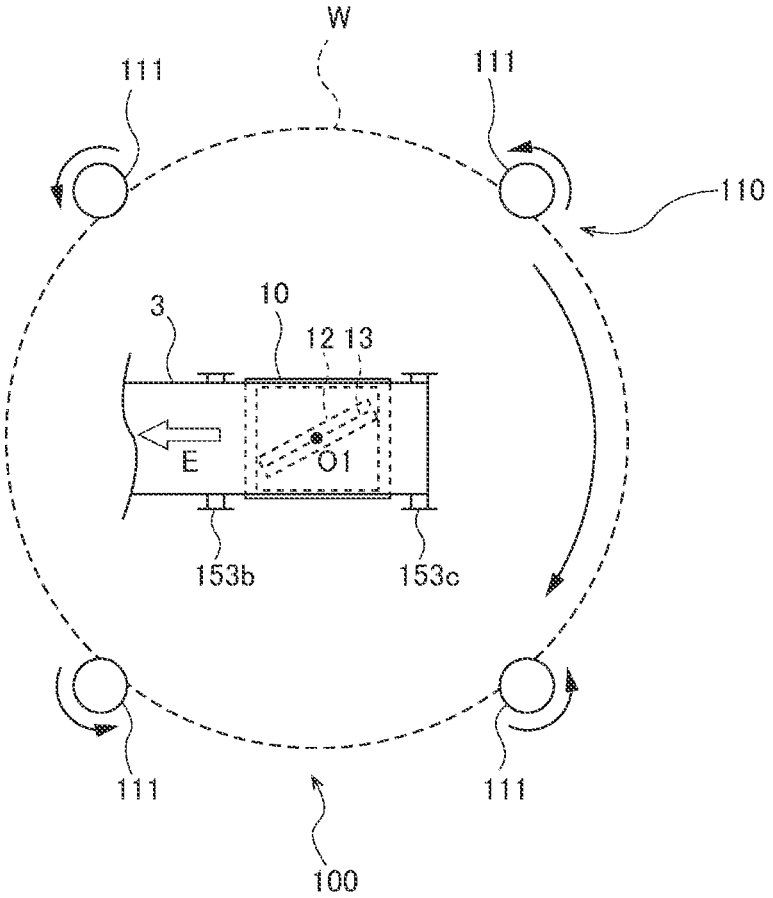
FIG. 4 is a plan view showing an arrangement of the polishing head shown in FIG. 2.

FIG. 4 is a plan view showing an arrangement of the polishing head 10 shown in FIG. 2. The fluid pressing structure 12 and the fluid supply port 13 of the polishing head 10 are arranged obliquely with respect to the advancing direction (indicated by an arrow E) of the polishing tape 3. As a result, the polishing tape 3 can contact the polishing point on the wafer W a plurality of times, so that the wafer W can be polished efficiently.

Angles of the fluid pressing structure 12 and the fluid supply port 13 of the present invention with respect to the advancing direction of the polishing tape 3 are not limited to the embodiment shown in FIG. 4. For example, the fluid pressing structure 12 and the fluid supply port 13 may be arranged perpendicularly to the advancing direction of the polishing tape 3. This arrangement of the fluid pressing structure 12 and the fluid supply port 13 perpendicular to the advancing direction of the polishing tape 3 can reduce a width of the polishing head 10 in the advancing direction of the polishing tape 3. Shapes of the fluid pressing structure 12 and the fluid supply port 13 of the present invention are also not limited to the embodiment shown in FIG. 4. For example, the fluid supply port 13 may have a shape that extends outward beyond a width of the polishing tape 3.

Next, operations of the polishing apparatus 100 of this embodiment will be described. The operations of the polishing apparatus 100 described below are controlled by the operation controller 180 shown in FIG. 1. The operation controller 180 is electrically connected to the liquid supply valve 33, the gas supply valve 34, the flow-rate controller 35, the flow-rate controller 36 (or the pressure controller), the substrate holder 110, the polishing-tape feeding mechanism 141, and the polishing-head moving mechanism 191. Operations of the liquid supply valve 33, the gas supply valve 34, the flow-rate controller 35, the flow-rate controller 36 (or the pressure controller), the substrate holder 110, the rinsing-liquid supply nozzle 127, the protective-liquid supply nozzle 128, the polishing-tape feeding mechanism 141, and the polishing-head moving mechanism 191 are controlled by the operation controller 180.

The operation controller 180 is composed of at least one computer. The operation controller 180 includes a memory 180*a* and an arithmetic device 180*b*. The arithmetic device 180*b* includes a CPU (central processing unit) or a GPU (graphic processing unit) configured to perform arithmetic operations according to instructions contained in programs stored in the memory 180*a*. The memory 180*a* includes a main memory (e.g., a random access memory) accessible by the arithmetic device 180*b*, and an auxiliary memory (e.g., a hard disk drive or a solid state drive) storing data and the programs therein.

The wafer W to be polished is held by the rollers 111 of the substrate holder 110 with the first surface 1 facing downward, and is rotated about the axis of the wafer W. Specifically, the substrate holder 110 rotates the wafer W by rotating the plurality of rollers 111 about the respective their own axes while the plurality of rollers 111 are in contact with the periphery of the wafer W with the first surface 1 of the wafer W facing downward. Next, the rinsing liquid is supplied onto the first surface 1 of the wafer W from the rinsing-liquid supply nozzle 127, and the protective liquid is supplied onto the second surface 2 of the wafer W from the protective-liquid supply nozzle 128. The rinsing liquid is supplied for cleaning the processing point on the first surface 1 of the wafer W and/or preventing area(s) other than the processing point from drying. The protective liquid spreads over the entire second surface 2 of the wafer W by centrifugal force.

The polishing-head moving mechanism 191 moves the polishing head 10 to a position below the center O1 of the first surface 1 of the wafer W. The operation controller 180 drives the polishing-tape feeding mechanism 141 to advance the polishing tape 3 in its longitudinal direction at a predetermined speed while applying a predetermined tension to the polishing tape 3. Next, the operation controller 180 instructs the liquid supply valve 33 and the gas supply valve 34 to open to thereby supply the fluid to the polishing head 10. The polishing head 10 brings the polishing surface 3*a* of the polishing tape 3 into contact with the first surface 1 of the wafer W by the fluid, and starts polishing the first surface 1 of the wafer W in the presence of the rinsing liquid. Further, the polishing-head moving mechanism 191 moves the polishing head 10, the polishing-tape feeding mechanism 141, and the guide rollers 153*a*, 153*b*, 153*c*, and 153*d* outwardly in the radial direction of the wafer W, while the polishing tape 3 is pressed against the first surface 1 of the wafer W by the fluid emitted from the polishing head 10. The operation controller 180 can regulate a pressing force of the fluid against the polishing tape 3 by controlling a flow rate supplied to the polishing head 10 by the flow-rate controller 35 and the flow-rate controller (or pressure controller) 36. During the polishing of the wafer W, the rinsing-liquid supply nozzle 127 and the protective-liquid supply nozzle 128 continue supplying the rinsing liquid and the protective liquid to the wafer W.

When the polishing head 10 reaches the outermost portion of the first surface 1 of the wafer W, the operation controller 180 instructs the polishing apparatus to terminate polishing of the wafer W. Specifically, the liquid supply valve 33 and the gas supply valve 34 are closed to stop supplying the fluid to the polishing head 10, so that the polishing tape 3 is separated from the first surface 1 of the wafer W. Thereafter, the operation controller 180 instructs the substrate holder 110, the rinsing-liquid supply nozzle 127, the protective-liquid supply nozzle 128, and the polishing-tape feeding mechanism 141 to stop their operations, so that the polishing of the wafer W is terminated. In one embodiment, the polishing-head moving mechanism 191 may reciprocate the polishing head 10 between the outermost portion and the center O1 of the first surface 1 of the wafer W.

According to the above-described embodiment, since the polishing head 10 presses the polishing tape 3 with the fluid without contacting the back surface of the polishing tape 3, no dynamic friction force is generated between the polishing tape 3 and the polishing head 10 when the polishing tape 3 is advanced during polishing of the wafer W. Therefore, the polishing tape 3 can be uniformly pressed against the flat portion of the wafer W by adjusting the pressure of the fluid supplied from the fluid pressing structure 12 of the polishing head 10 such that the pressing force is uniform, and as a result, the flat portion of the wafer W can be uniformly polished.

In particular, in this embodiment, a fluid mixture of the liquid and the gas is used as the fluid for pressing the polishing tape 3. This fluid mixture is emitted as a two-fluid jet from the polishing head 10 onto the back surface of the polishing tape 3. The fluid mixture can press the polishing tape 3 against the wafer W with a greater pressing force than the liquid alone.

In addition, the fluid supplied from the polishing head 10 to the back surface of the polishing tape 3 can cool friction heat generated between the wafer W and the polishing tape 3 when the wafer W is polished. Generally, the friction heat generated at the polishing point of the wafer W may cause a decrease in polishing performance of the polishing tape 3, and as a result, a polishing rate may be lowered. Therefore, the polishing rate can be improved by cooling the friction heat with the fluid.

Furthermore, the fluid supplied from the polishing head 10 to the back surface of the polishing tape 3 flows over to the polishing point of the wafer W, so that polishing debris can be removed from the first surface 1 of the wafer W.

Figure 5:
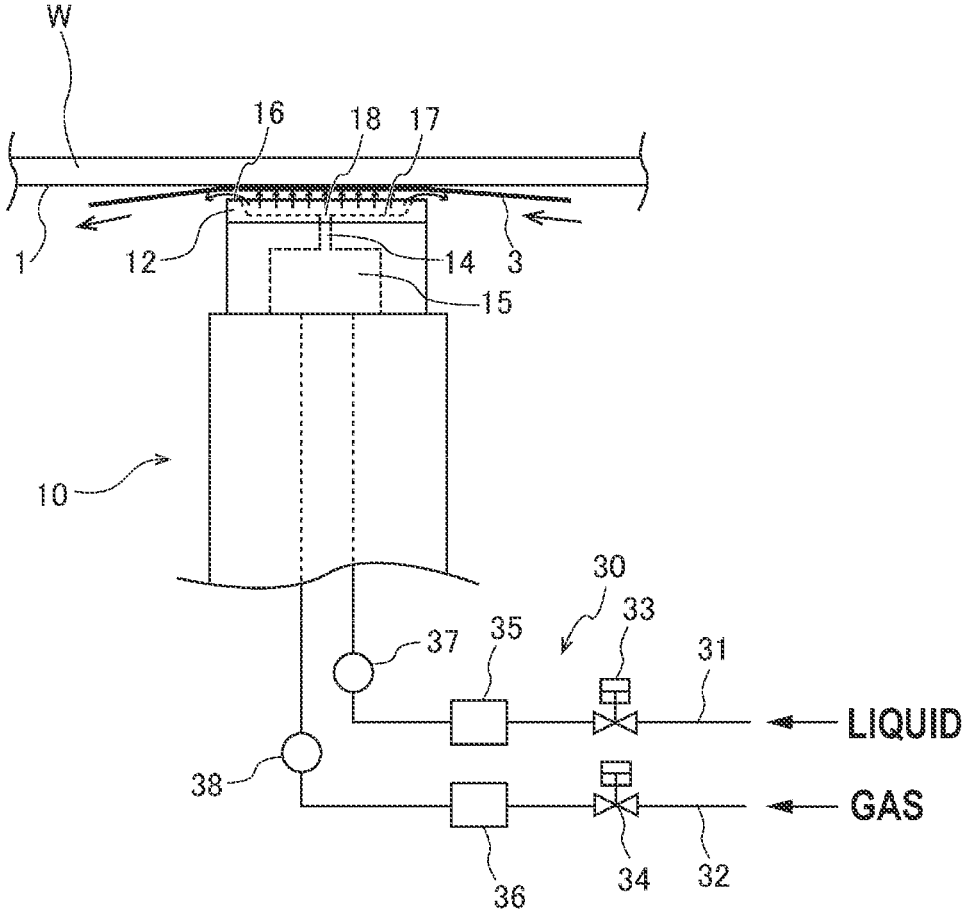
FIG. 5 is a schematic diagram showing another embodiment of the polishing head.
Figure 6:
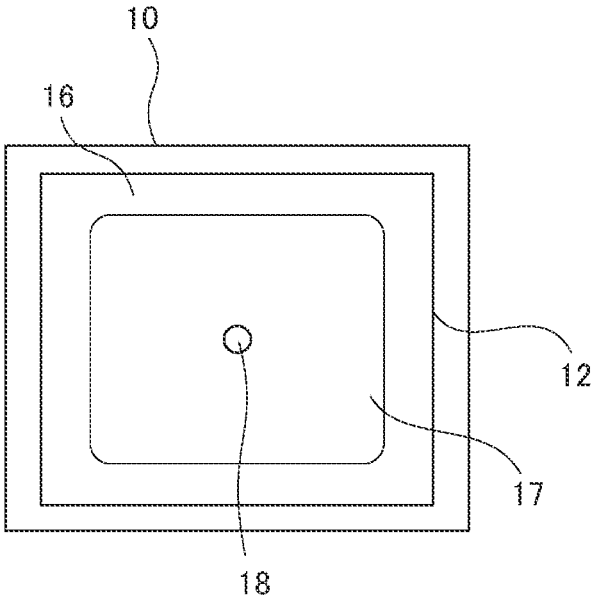
FIG. 6 is a plan view of the polishing head shown in FIG. 5.

FIG. 5 is a schematic diagram showing another embodiment of the polishing head 10. FIG. 6 is a plan view of the polishing head 10 shown in FIG. 5. FIG. 5 illustrates the polishing tape 3 when being pressed against the first surface 1 of the wafer W by the fluid supplied from the polishing head 10. Details of this embodiment, which will not be particularly described, are the same as those of the above-described embodiment with reference to FIGS. 1 to 4, and duplicated descriptions will be omitted.

The polishing head 10 has a fluid pressing structure 12, a flow passage 14, and a fluid mixing chamber 15. In the polishing head 10 of this embodiment, the fluid pressing structure 12 is constituted of an area pad. The fluid pressing structure 12 is arranged in the upper portion of the polishing head 10, and as shown in FIG. 6, the fluid pressing structure 12 has a rectangular shape when the polishing head 10 is viewed from above. A pressing surface 16, which is an upper surface of the fluid pressing structure 12, has a rectangular-shaped recess 17 formed in the center of the pressing surface 16, and a fluid supply port 18 is formed in the center of the recess 17. Two or more fluid supply ports 18 may be formed.

The flow passage 14 communicates with the fluid supply port 18 and the fluid mixing chamber 15.

A fluid mixture produced in the fluid mixing chamber 15 flows through the flow passage 14, is supplied from the fluid supply port 18 into the recess 17 to fill the recess 17, and further flows out toward an outside of the fluid pressing structure 12. The fluid supply port 18 and the recess 17 are arranged so as to face the back surface of the polishing tape 3. A gap between the pressing surface 16 of the fluid pressing structure 12 and the back surface of the polishing tape 3 is filled with the fluid, so that the polishing tape 3 can be pressed against the first surface 1 of the wafer W with the entire pressing surface 16 including the recess 17.

Figure 7:
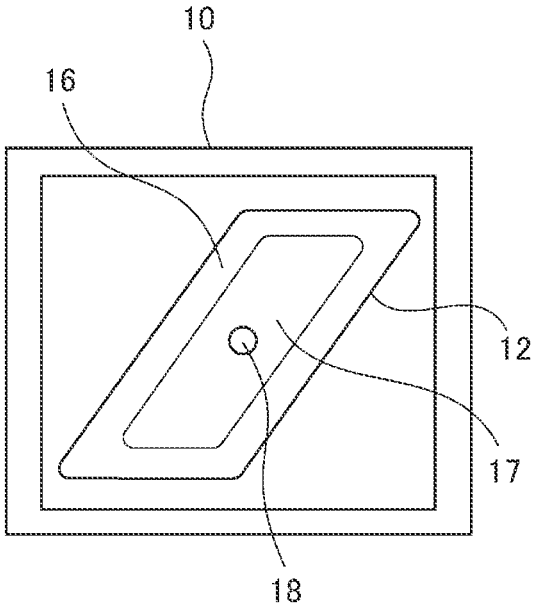
FIG. 7 is a plan view showing another embodiment of a fluid pressing structure.

FIG. 7 is a plan view showing another embodiment of the fluid pressing structure 12. Details of this embodiment, which will not be particularly described, are the same as those of the above-described embodiment described with reference to FIGS. 5 and 6, and duplicated descriptions will be omitted. As shown in FIG. 7, the fluid pressing structure 12 may have a parallelogram shape when the polishing head 10 is viewed from above. A pressing surface 16, which is the upper surface of the fluid pressing structure 12, has a parallelogram-shaped recess 17 formed in the center of the pressing surface 16, and a fluid supply port 18 is formed in the center of the recess 17. Two or more fluid supply ports 18 may be formed. The flow passage 14 communicates with the fluid supply port 18 and the fluid mixing chamber 15.

Figure 8:
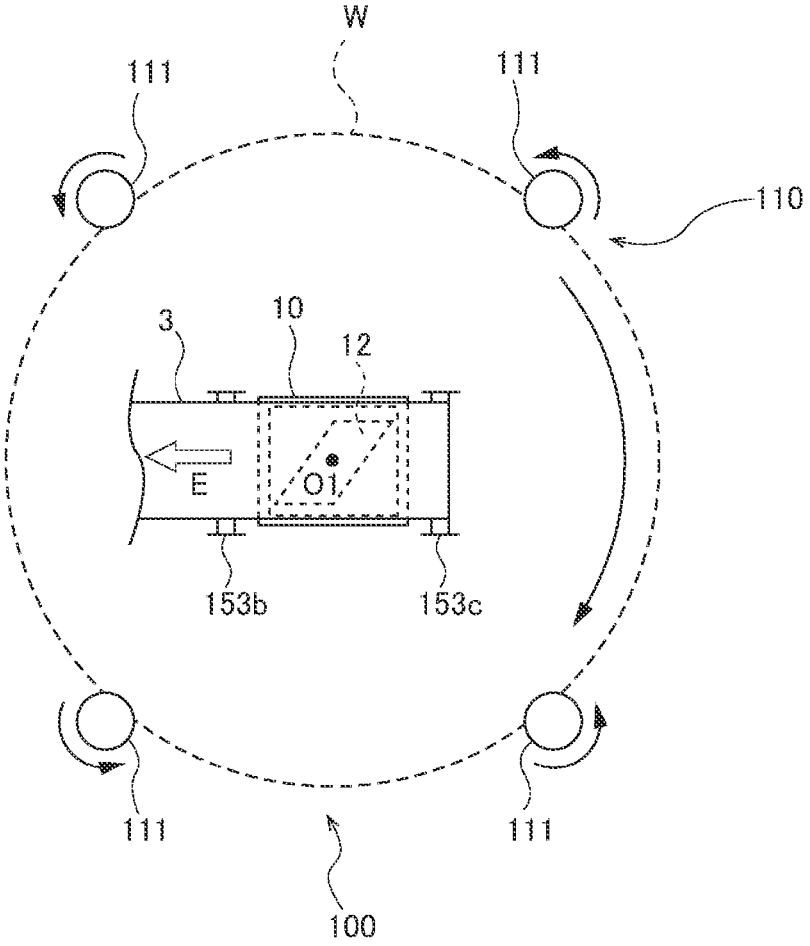
FIG. 8 is a plan view showing an arrangement of the polishing head shown in FIG. 7.

FIG. 8 is a plan view showing an arrangement of the polishing head 10 shown in FIG. 7. The fluid pressing structure 12 is arranged so as to form a parallelogram having two sides parallel to the advancing direction (indicated by an arrow E) of the polishing tape 3 when the polishing head 10 is viewed from above. As a result, the polishing tape 3 can be brought into contact with the polishing point on the wafer W multiple times, so that the wafer W can be polished efficiently. The shape of the fluid pressing structure 12 of this invention is not limited to the embodiment shown in FIG. 8. For example, the fluid pressing structure 12 may have a shape that extends outward beyond the width of the polishing tape 3.

In the embodiments shown in FIGS. 5 to 8, liquid may be used instead of the fluid mixture of the liquid and the gas as the fluid for pressing the polishing tape 3 against the wafer W.

Figure 9:
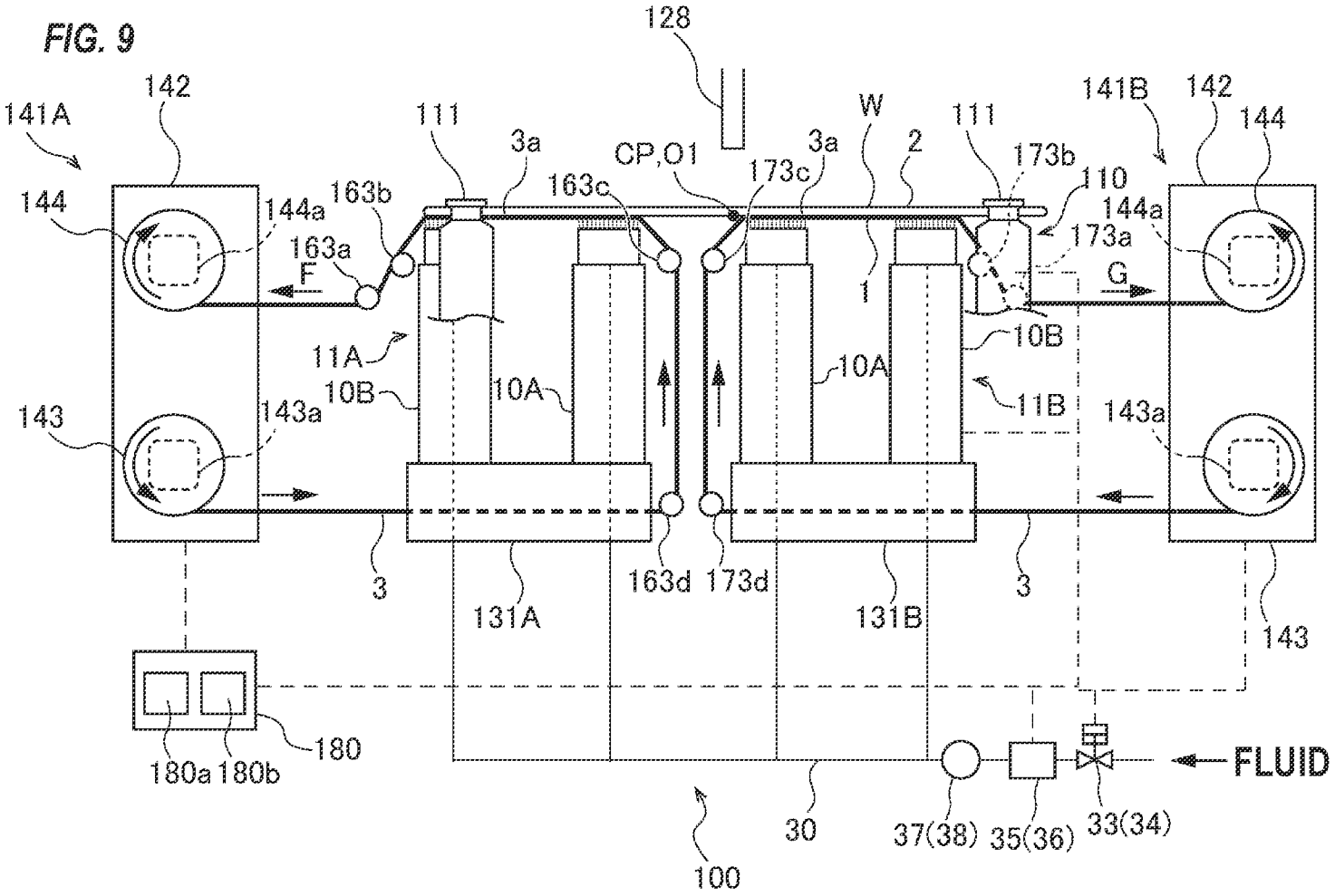
FIG. 9 is a schematic diagram showing another embodiment of the polishing apparatus.

FIG. 9 is a schematic diagram showing another embodiment of the polishing apparatus. Details of this embodiment, which will not be particularly described, are the same as those of the above-described embodiments with reference to FIGS. 1 to 8, and duplicated descriptions will be omitted. In FIG. 9, depiction of the rinsing-liquid supply nozzle 127 is omitted. The polishing apparatus 100 of this embodiment includes polishing-head assemblies 11A and 11B, and polishing-tape feeding mechanisms 141A and 141B configured to feed polishing tapes 3 to the polishing-head assemblies 11A and 11B, respectively. The polishing-head assembly 11A includes polishing heads 10A and 10B. Similarly, the polishing-head assembly 11B includes polishing heads 10A and 10B. The polishing-head assembly 11A is supported by a supporting member 131A, and the polishing-head assembly 11B is supported by a supporting member 131B.

The polishing tape 3 fed to the polishing-head assembly 11A is supported by guide rollers 163*a*, 163*b*, 163*c*, and 163*d*, and the polishing tape 3 fed to the polishing-head assembly 11B is supported by guide rollers 173*a*, 173*b*, 173*c*, and 173*d*. Configurations of the polishing-tape feeding mechanisms 141A and 141B, the supporting members 131A and 131B, the guide rollers 163*a*, 163*b*, 163*c*, and 163*d*, and the guide rollers 173*a*, 173*b*, 173*c*, and 173*d* are the same as those of the polishing-tape feeding mechanism 141, the supporting member 131, and the guide rollers 153*a*, 153*b*, 153*c*, and 153*d* described with reference to FIG. 1. The polishing apparatus 100 of this embodiment does not include the polishing-head moving mechanism 191. Therefore, positions of the polishing-head assemblies 11A and 11B are fixed during polishing.

Figure 10:
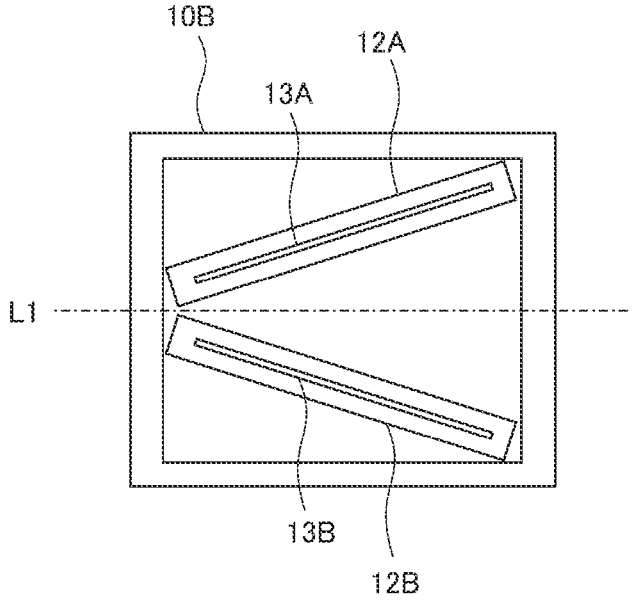
FIG. 10 is a plan view showing a polishing head in which fluid pressing structures include two slit nozzles.

The polishing head 10A corresponds to the polishing head 10 described with reference to FIGS. 2 to 4 in which the fluid pressing structure 12 includes the slit nozzle. FIG. 10 is a plan view showing the polishing head 10B in which fluid pressing structures 12A and 12B include two slit nozzles. Details of the fluid pressing structures 12A and 12B of this embodiment, which will not be specifically described, are the same as those of the fluid pressing structure 12 described with reference to FIGS. 2 to 4, and duplicated descriptions will be omitted. The polishing head 10B has the two fluid pressing structures 12A and 12B. Fluid supply ports 13A and 13B are formed in the fluid pressing structures 12A and 12B, respectively. The two fluid pressing structures 12A and 12B are arranged in an upper portion of the polishing head 10B, and are arranged symmetrically with respect to a center line L1 of the polishing head 10B extending in the advancing direction of the polishing tape 3 (not shown in FIG. 10). In one embodiment, the two fluid pressing structures 12A and 12B may not be arranged symmetrically with respect to the center line L1 as long as the fluid pressing structures 12A and 12B are arranged obliquely with respect to the advancing direction of the polishing tape 3.

Figure 11:
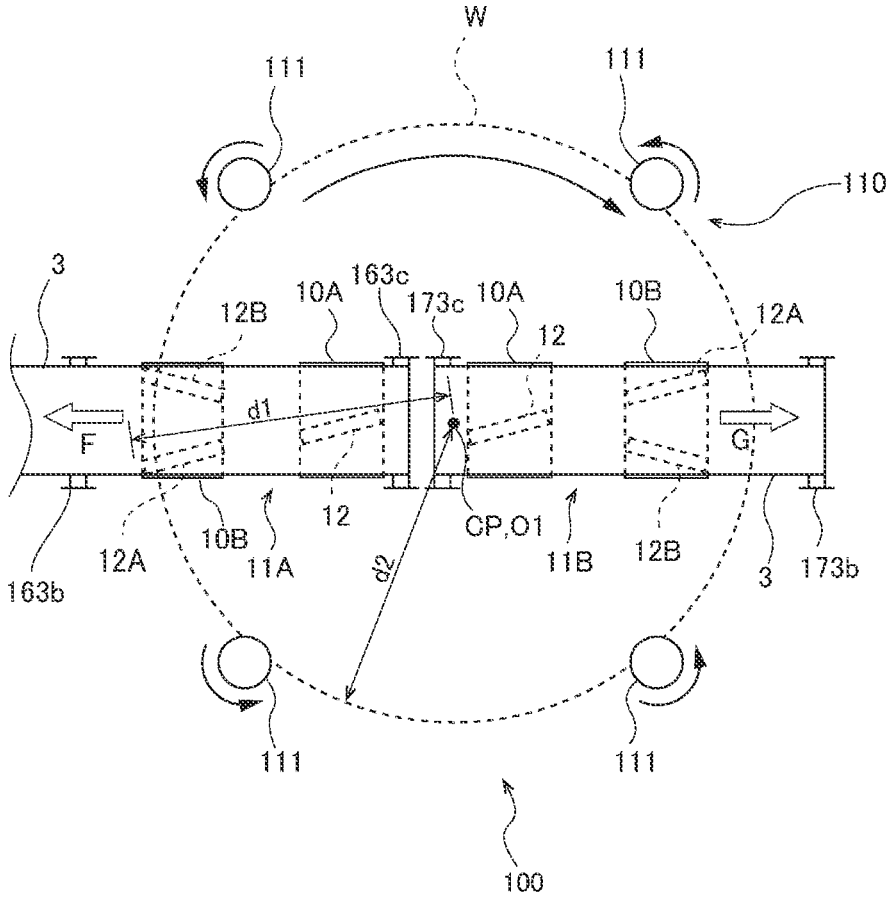
FIG. 11 is a plan view showing an arrangement of the polishing heads shown in FIG. 9.

FIG. 11 is a plan view showing an arrangement of the polishing heads 10A and 10B shown in FIG. 9. The plurality of polishing heads 10A and 10B are arranged at different distances from an axis CP of the substrate holder 110 (the center O1 of the first surface 1 of the wafer W). A distance d1 from the axis CP of the substrate holder 110 to an outermost end of the fluid pressing structure is longer than a radius d2 of the wafer W.

During polishing, the polishing-tape feeding mechanism 141A advances the polishing tape 3 in a direction indicated by an arrow F shown in FIGS. 9 and 11, and the polishing-tape feeding mechanism 141B advances the other polishing tape 3 in a direction indicated by an arrow G shown in FIGS. 9 and 11. Specifically, each of the polishing tapes 3 is advanced from a center region of the wafer W toward the periphery of the wafer W. As a result, polishing debris generated by polishing of the wafer W can be efficiently discharged from the center region of the wafer W to an outside of the wafer W.

The plurality of polishing heads 10A and 10B are configured to be operable independently of each other. The polishing heads 10A and 10B of the polishing-head assembly 11A are aligned with a gap along the advancing direction F of the polishing tape 3 (i.e., the longitudinal direction of the polishing tape 3). The polishing heads 10A and 10B of the polishing-head assembly 11B are aligned with a gap along the advancing direction G of the polishing tape 3 (i.e., the longitudinal direction of the polishing tape 3). Each of the plurality of fluid pressing structures 12, 12A, and 12B of this embodiment extends obliquely with respect to the advancing directions F and G of the polishing tapes 3. When viewed from the advancing direction F or the advancing direction G of the polishing tape 3, the plurality of fluid pressing structures 12, 12A, and 12B are continuously aligned along a direction perpendicular to the advancing directions F and G of the polishing tapes 3. Furthermore, when viewed from the advancing direction F or the advancing direction G of the polishing tape 3, the plurality of fluid pressing structures 12, 12A, and 12B are continuously arranged without gaps.

Although the plurality of fluid pressing structures 12, 12A, and 12B are not aligned on a straight line, the plurality of fluid pressing structures 12, 12A, and 12B are located at different distances from the axis CP of the substrate holder 110, so that when the wafer W is rotating, each region of the first surface 1 of the wafer W passes through one of the plurality of fluid pressing structures 12, 12A, and 12B. Therefore, the polishing tapes 3 can be pressed against the entire first surface 1 of the wafer W by the fluid supplied from the plurality of fluid pressing structures 12, 12A, and 12B.

Angles of the fluid pressing structures 12, 12A, and 12B and the fluid supply ports 13, 13A, and 13B with respect to the advancing directions of the polishing tapes 3 are not limited to the embodiment shown in FIG. 11. For example, the fluid pressing structures 12, 12A, and 12B and the fluid supply ports 13, 13A, and 13B may be arranged perpendicularly to the advancing directions of the polishing tapes 3. The arrangements of the fluid pressing structures 12, 12A, and 12B and the fluid supply ports 13, 13A, and 13B perpendicularly to the advancing directions of the polishing tapes 3 can reduce the width of the polishing head 10 in the advancing directions of the polishing tapes 3.

Figure 12:
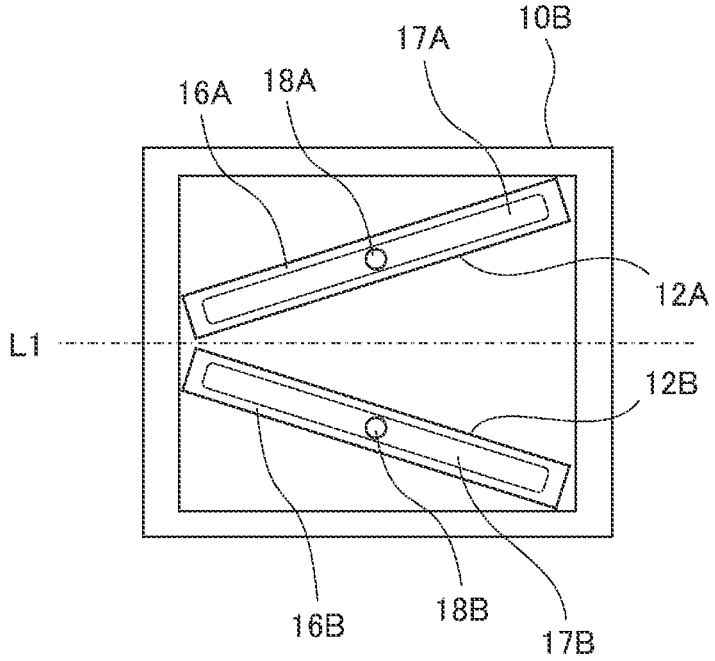
FIG. 12 is a plan view showing a polishing head in which fluid pressing structures include two area pads.

FIG. 12 is a plan view of the polishing head 10 in which fluid pressing structures 12A and 12B include two area pads. The fluid pressing structures 12A and 12B of this embodiment, which will not be particularly described, are the same as the fluid pressing structure 12 described with reference to FIGS. 7 and 8, and duplicated descriptions will be omitted. The polishing head 10B has the two fluid pressing structures 12A and 12B each having a rectangular shape when the polishing head 10B is viewed from above. A pressing surface 16A, which is an upper surface of the fluid pressing structure 12A, has a rectangular-shaped recess 17A in the center of the pressing surface 16A. A fluid supply port 18A is formed in the center of the recess 17A. Similarly, a recess 17B is formed in a pressing surface 16B, which is an upper surface of the fluid pressing structure 12B, and a fluid supply port 18B is formed in the recess 17B. The two fluid pressing structures 12A and 12B are arranged in the upper portion of the polishing head 10B. The fluid pressing structure 12A and the fluid pressing structure 12B are arranged symmetrically with respect to a center line L1 of the polishing head 10B extending in the advancing direction of the polishing tape 3 (not shown in FIG. 12). In one embodiment, the two fluid pressing structures 12A and 12B may not be arranged symmetrically with respect to the center line L1 as long as the fluid pressing structures 12A and 12B are arranged obliquely with respect to the advancing direction of the polishing tape 3.

In one embodiment, the polishing head 10A may be the polishing head 10 having the fluid pressing structure 12 described with reference to FIGS. 7 and 8, instead of the polishing head 10 having the fluid pressing structure 12 described with reference to FIGS. 3 and 4. The polishing head 10B may be the polishing head 10B having the two fluid pressing structures 12A and 12B described with reference to FIG. 12, instead of the two fluid pressing structures 12A and 12B described with reference to FIGS. 10 and 11.

According to the above-described embodiment, since the polishing heads 10A and 10B press the polishing tape 3 with the fluid without contacting the back surface of the polishing tape 3, no dynamic friction force is generated between the polishing tapes 3 and the polishing heads 10A and 10B when the polishing tapes 3 are advanced during polishing of the wafer W. Therefore, the polishing tapes 3 can be uniformly pressed against the flat portion of the wafer W by adjusting the pressure of the fluid supplied from the fluid pressing structures 12 of the polishing heads 10A and 10B such that the pressing forces are uniform. As a result, the flat portion of the wafer W can be uniformly polished.

Further, the fluid supplied from the polishing heads 10A and 10B to the back surfaces of the polishing tapes 3 can cool friction heat generated between the wafer W and the polishing tapes 3 when the wafer W is polished. Generally, the friction heat generated at the polishing point of the wafer W may cause a decrease in polishing performance of the polishing tape 3, and as a result, a polishing rate is lowered. Therefore, the polishing rate can be improved by cooling the friction heat with the fluid.

Furthermore, the fluid supplied from the polishing heads 10A and 10B to the back surfaces of the polishing tapes 3 flows over to the polishing points of the wafer W, so that polishing debris can be removed from the first surface 1 of the wafer W.

Figure 13:
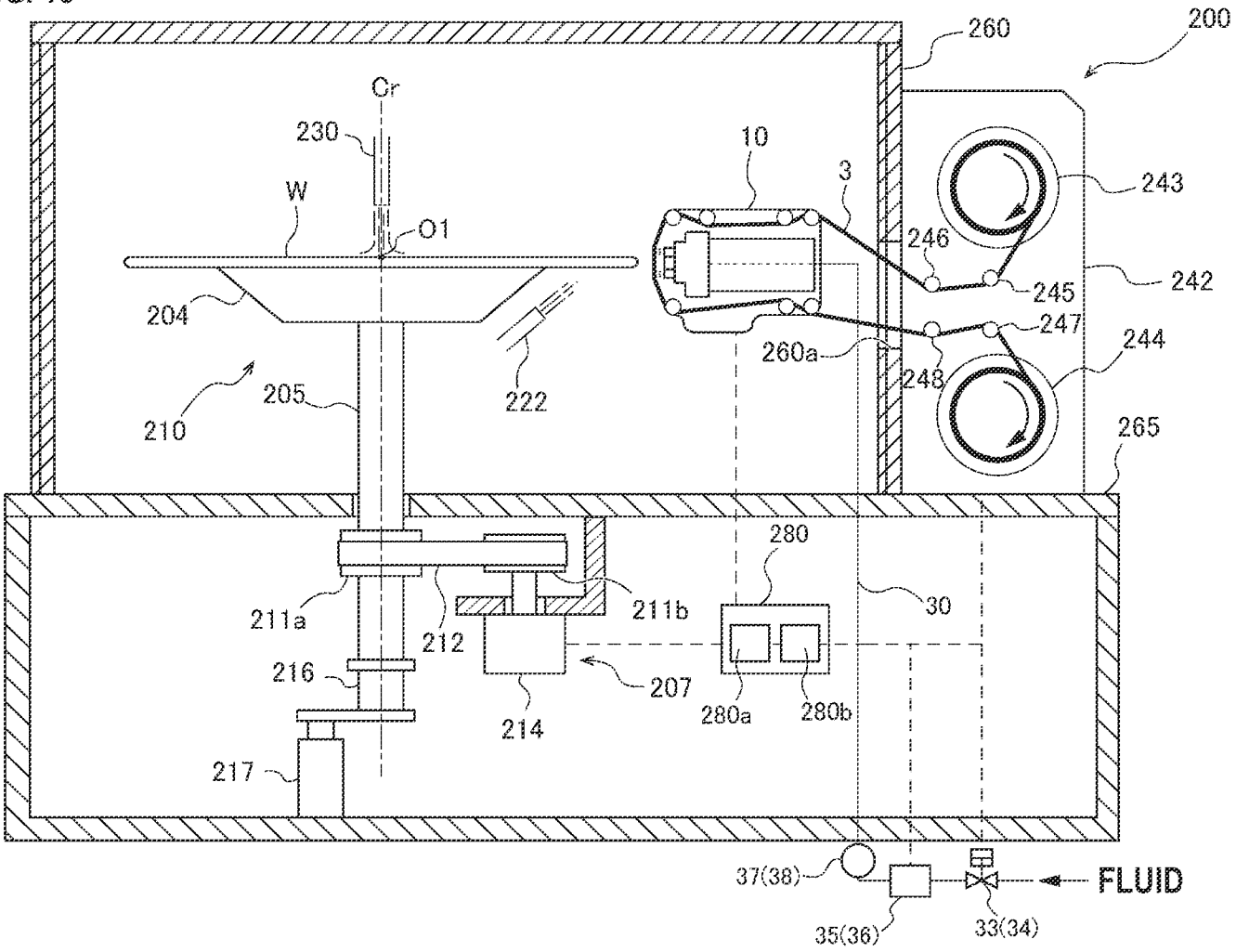
FIG. 13 is a schematic diagram showing still another embodiment of a polishing apparatus.

FIG. 13 is a schematic diagram showing still another embodiment of the polishing apparatus. A polishing apparatus 200 shown in FIG. 13 is suitably used for polishing a periphery of a substrate (e.g., a wafer). In this specification, the periphery of the substrate is defined as a region including a bevel portion located in an outermost circumference of the substrate and an edge portion which is a flat portion located radially inwardly of the bevel portion. More specifically, the edge portion includes a top edge portion and a bottom edge portion.

Figure 14A:
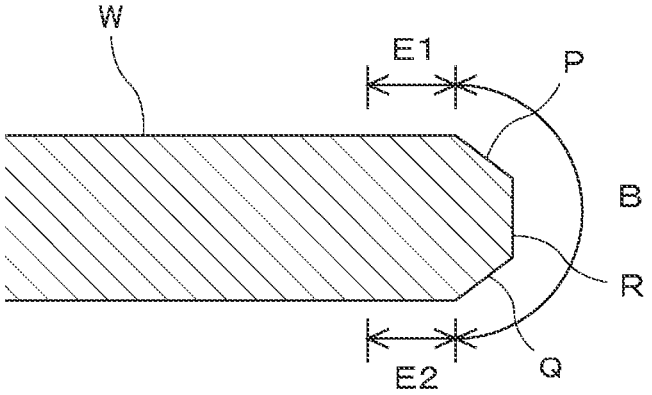
FIG. 14A is an enlarged cross-sectional view showing a periphery of a substrate.
Figure 14B:
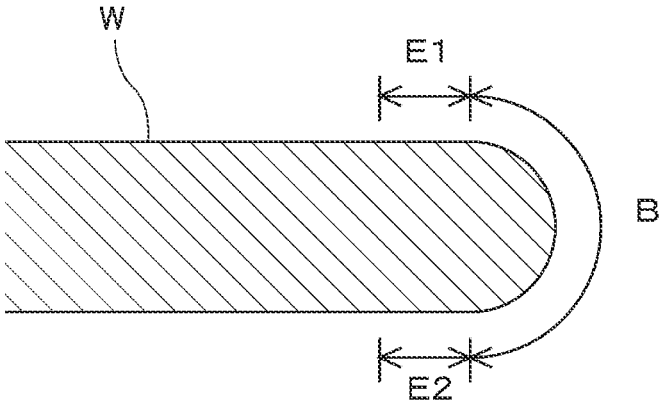
FIG. 14B is an enlarged cross-sectional view showing a periphery of a substrate.

FIGS. 14A and 14B are enlarged cross-sectional views each showing the periphery of the substrate. FIG. 14A is a cross-sectional view of a substrate of a so-called straight type, and FIG. 14B is a cross-sectional view of a substrate of a so-called round type. In the substrate W shown in FIG. 14A, the bevel portion is the outermost circumferential surface (indicated by symbol B) including an upper slope portion (or an upper bevel portion) P, a lower slope (or a lower bevel portion) Q, and a side portion (or an apex) R of the substrate W. In the substrate W shown in FIG. 14B, the bevel portion is a portion (indicated by symbol B) constituting an outermost circumferential surface of the substrate W and having a curved cross section. The top edge portion is an annular flat portion E1 located radially inwardly of the bevel portion B, and is a region located within a device surface of the substrate W. The bottom edge portion is an annular flat portion E2 located at the opposite side from the top edge portion and is located radially inwardly of the bevel portion B. The top edge portion E1 may include a region where devices are formed.

Referring back to FIG. 13, the polishing apparatus 200 includes a substrate holder 210 configured to hold and rotate a wafer W, which is an example of a substrate, a polishing head 10 configured to polish a periphery of the wafer W held by the substrate holder 210, a lower-side supply nozzle 222 configured to supply liquid onto a lower surface of the wafer W, and an upper-side supply nozzle 230 configured to supply liquid onto an upper surface of the wafer W. An example of the liquid supplied to the wafer W includes pure water. During polishing of the wafer W, the liquid is supplied onto the lower surface of the wafer from the lower-side supply nozzle 222, and the liquid is supplied onto the upper surface of the wafer W from the upper-side supply nozzle 230.

FIG. 13 illustrates the substrate holder 210 when holding the wafer W. The polishing head 10 faces the periphery of the wafer W when the wafer W is held by the substrate holder 210. The substrate holder 210 includes a holding stage 204 configured to hold the wafer W by vacuum suction, a shaft 205 coupled to a center portion of the holding stage 204, and a holding-stage driving mechanism 207 configured to rotate and vertically move the holding stage 204. The holding-stage driving mechanism 207 is configured to be able to rotate the holding stage 204 about its axis Cr, and vertically move the holding stage 204 along the axis Cr.

The polishing head 10, the holding stage 204, the lower-side supply nozzle 222, and the upper-side supply nozzle 230 are arranged in an interior of a partition wall 260. The interior of the partition wall 260 constitutes a polishing chamber in which the wafer W is to be polished. The partition wall 260 is located on a base plate 265. The shaft 205 extends through the base plate 265.

The holding-stage driving mechanism 207 includes a motor 214 as a stage rotating device configured to rotate the holding stage 204, and an air cylinder 217 configured to vertically move the holding stage 204. The motor 214 is fixed to a lower surface of the base plate 265. The holding stage 204 is rotated by the motor 214 via the shaft 205, a pulley 211*a* coupled to the shaft 205, a pulley 211*b* attached to a rotating shaft of the motor 214, and a belt 212 riding on these pulleys 211*a* and 211*b*. The rotating shaft of the motor 214 extends parallel to the shaft 205. With such a configuration, the wafer W held on an upper surface of the holding stage 204 is rotated by the motor 214. The shaft 205 is coupled to the air cylinder 217 via a rotary joint 216 attached to a lower end of the shaft 205, so that the air cylinder 217 can raise and lower the shaft 205 and the holding stage 204.

The wafer W is placed on the upper surface of the holding stage 204 by a not-shown transfer mechanism such that the center O1 of the wafer W is located on the axis Cr of the holding stage 204. The wafer W is held on the upper surface of the holding stage 204 with a device surface of the wafer W facing upward. With such a configuration, the substrate holder 210 can rotate the wafer W about the axis Cr of the holding stage 204 (i.e., an axis of the wafer W), and can raise and lower the wafer W along the axis Cr of the holding stage 204.

The polishing head 10 is configured to press the polishing tape 3 against the edge portion of the wafer W with fluid. The polishing head 10 is coupled to a fluid supply line 30, and the fluid is supplied from a not-shown fluid supply source. Details of the polishing head 10 will be described later.

The polishing apparatus 200 further includes a polishing-tape feeding mechanism 242 configured to feed the polishing tape 3 to the polishing head 10 and collect the polishing tape 3 from the polishing head 10. The polishing-tape feeding mechanism 242 is disposed outside the partition wall 260. The polishing-tape feeding mechanism 242 includes a tape feeding reel 243 configured to feed the polishing tape 3 to the polishing head 10, and a tape take-up reel 244 configured to collect the polishing tape 3 that has been used in polishing of the wafer W. The polishing tape 3 is advanced or fed from the tape feeding reel 243 via a fluid pressing structure 12 of the polishing head 10 in a direction indicated by an arrow depicted in the tape take-up reel 244 by rotating the tape take-up reel 244 in the direction indicated by the arrow.

Not-shown tension motors are coupled to the tape feeding reel 243 and the tape take-up reel 244, respectively. A tension motor coupled to the tape feeding reel 243 can apply a predetermined torque to the tape feeding reel 243 to apply tension to the polishing tape 3. A tension motor coupled to the tape take-up reel 244 is controlled so as to advance the polishing tape 3 at a constant speed. An advancing speed of the polishing tape 3 can be changed by changing a rotating speed of the tape take-up reel 244. In one embodiment, the advancing direction of the polishing tape 3 may be opposite to the direction indicated by the arrow shown in FIG. 13 (i.e., arrangements of the tape feeding reel 243 and the tape take-up reel 244 may be interchanged). A tape advancing device may be provided in addition to the tape take-up reel 244. In this case, the tension motor coupled to the tape take-up reel 244 can apply tension to the polishing tape 3 by applying a predetermined torque to the tape take-up reel 244.

The polishing tape 3 is fed to the polishing head 10 such that the polishing surface of the polishing tape 3 faces the periphery of the wafer W. The polishing tape 3 is fed from the tape feeding reel 243 to the polishing head 10 through an opening 260*a* formed in the partition wall 260, and the used polishing tape 3 is collected by the tape take-up reel 244 through the opening 260*a*. The polishing-tape feeding mechanism 242 further includes a plurality of guide rollers 245, 246, 247, and 248 configured to support the polishing tape 3. The advancing direction of the polishing tape 3 is guided by the guide rollers 245, 246, 247, and 248.

Figure 15:
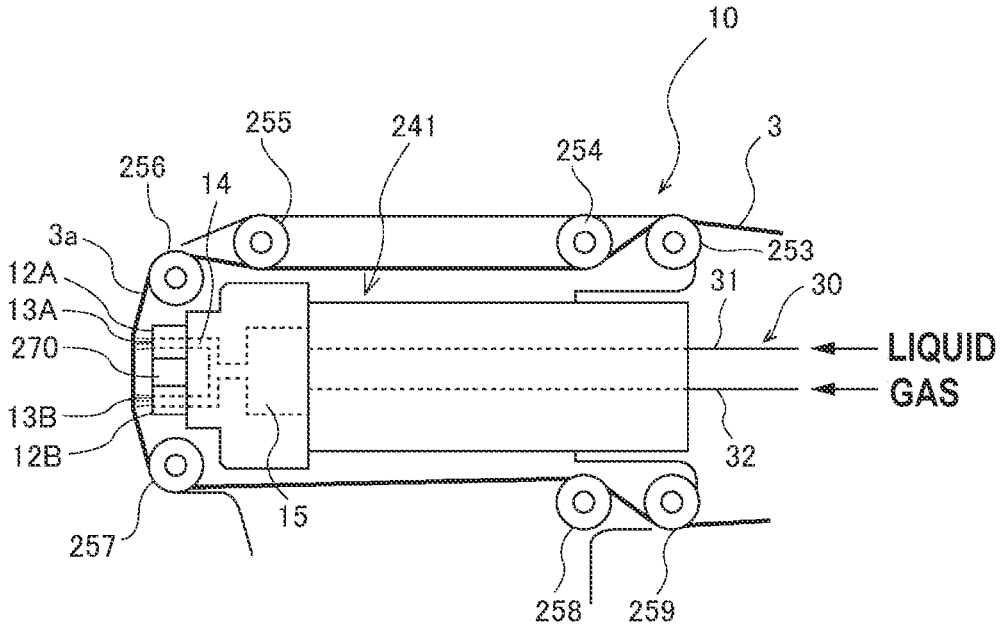
FIG. 15 is a schematic diagram showing a polishing head of the polishing apparatus shown in FIG. 13.
Figure 16:
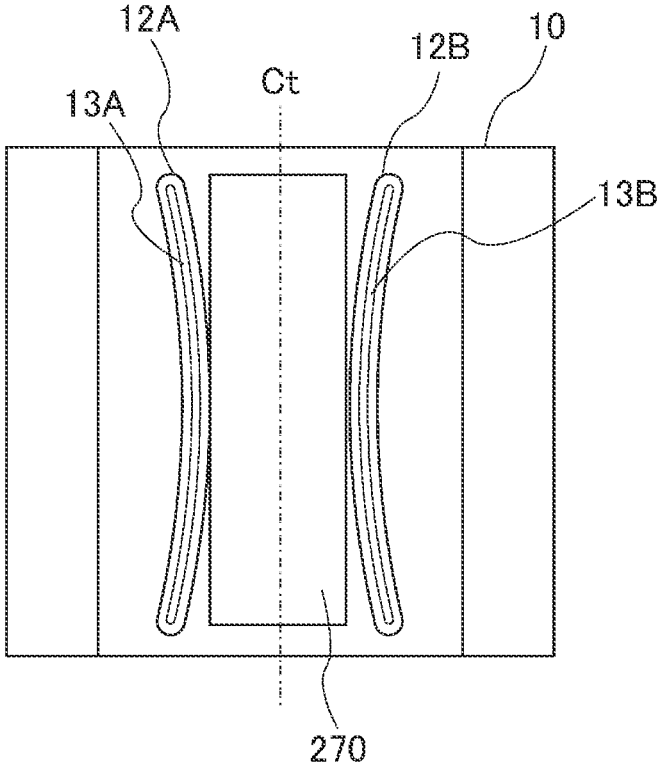
FIG. 16 is a plan view of the polishing head shown in FIG. 15.

FIG. 15 is a schematic diagram showing the polishing head 10 of the polishing apparatus 200 shown in FIG. 13. FIG. 16 is a plan view of the polishing head 10 shown in FIG. 15. The polishing head 10 includes two fluid pressing structures 12A and 12B configured to press the polishing surface 3*a* of the polishing tape 3 with the fluid against the edge portion of the wafer W. Details of the fluid pressing structures 12A and 12B of this embodiment, which will not be particularly described, are the same as those of the fluid pressing structure 12 of the embodiment described with reference to FIGS. 2 and 3, and duplicated descriptions will be omitted. In FIG. 15, depiction of the liquid supply valve 33, the gas supply valve 34, the flow-rate controller 35, the flow-rate controller (or pressure controller) 36, the flow meter 37, and the flow meter (or pressure gauge) 38 is omitted.

The polishing head 10 has a plurality of guide rollers 253, 254, 255, 256, 257, 258, and 259 configured to guide the polishing tape 3 from the tape feeding reel 243 (see FIG. 13) to the tape take-up reel 244 (see FIG. 13) via the fluid pressing structures 12A and 12B of the polishing head 10. These guide rollers guide the polishing tape 3 such that the polishing tape 3 advances in a direction perpendicular to a tangential direction of the wafer W.

The polishing head 10 has the fluid pressing structures 12A and 12B including two slit nozzles, a flow passage 14, and a fluid mixing chamber 15. The fluid pressing structure 12A and the fluid pressing structure 12B are arranged in parallel, and arranged symmetrically with respect to a center line Ct. Slit-shaped fluid supply ports 13A and 13B are formed in the two fluid pressing structures 12A and 12B, respectively. The two fluid pressing structures 12A and 12B and the two fluid supply ports 13A and 13B are curved inwardly toward the center line Ct. More specifically, the fluid pressing structures 12A and 12B and the fluid supply ports 13A and 13B each has an arc shape having a curvature substantially the same as a curvature of a peripheral shape of the wafer W (not shown in FIG. 16) which is an object to be polished.

The flow passage 14 communicates with the fluid supply ports 13A and 13B and the fluid mixing chamber 15. The fluid mixture mixed in the fluid mixing chamber 15 flows through the flow passage 14 and is supplied from the fluid supply ports 13A and 13B toward the back surface of the polishing tape 3. The fluid supply ports 13A and 13B are arranged so as to face the back surface of the polishing tape 3, so that the polishing tape 3 can be pressed against the edge portion of the wafer W by the fluid supplied from the fluid supply ports 13A and 13B.

In this embodiment, liquid and gas are mixed in the fluid mixing chamber 15 in the polishing head 10 to produce the fluid mixture, while in one embodiment, the fluid supply line 30 through which a fluid mixture mixed in advance flows may communicate with the flow passage 14 without passing through the fluid mixing chamber 15, and the fluid mixture may be directly supplied to the fluid pressing structures 12A and 12B. In one embodiment, one of the liquid supply line 31 and the gas supply line 32 may communicate with the flow passage 14 without passing through the fluid mixing chamber 15, and only one of the liquid or the gas may be supplied to the fluid pressing structures 12A and 12B.

The polishing head 10 may further have a pressing pad (or a bevel pad) 270 disposed between the fluid pressing structure 12A and the fluid pressing structure 12B. The pressing pad 270 is made of closed-cell form material, such as silicone rubber, which has elasticity. When the polishing head 10 is moved toward the wafer W by a not-shown pressing mechanism, the pressing pad 270 presses the polishing tape 3 from its back side against the bevel portion of the wafer W, so that the polishing head 10 polishes the bevel portion of the wafer W. In order to reduce friction with the back surface of the polishing tape 3, a sheet whose surface is covered with fluororesin may be attached to a front surface (or a pressing surface) of the pressing pad 270. The pressing pad 270 is detachable with a bolt or the like.

Figure 17:
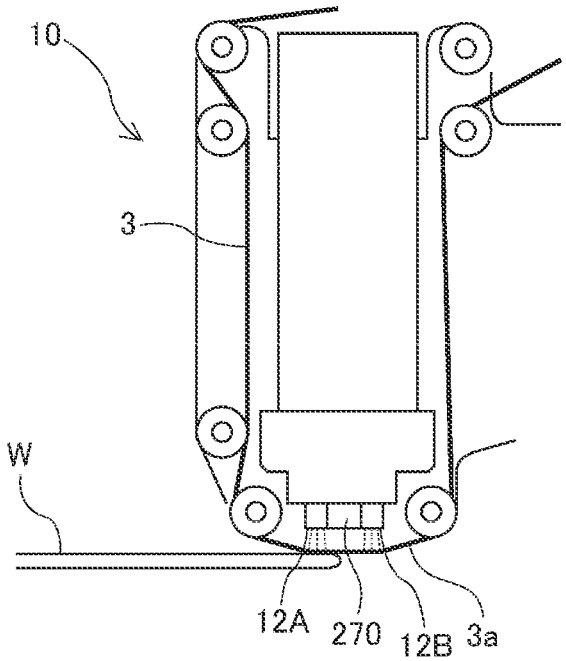
FIG. 17 is a diagram showing the polishing head tilted upward by a tilting mechanism.
Figure 18:
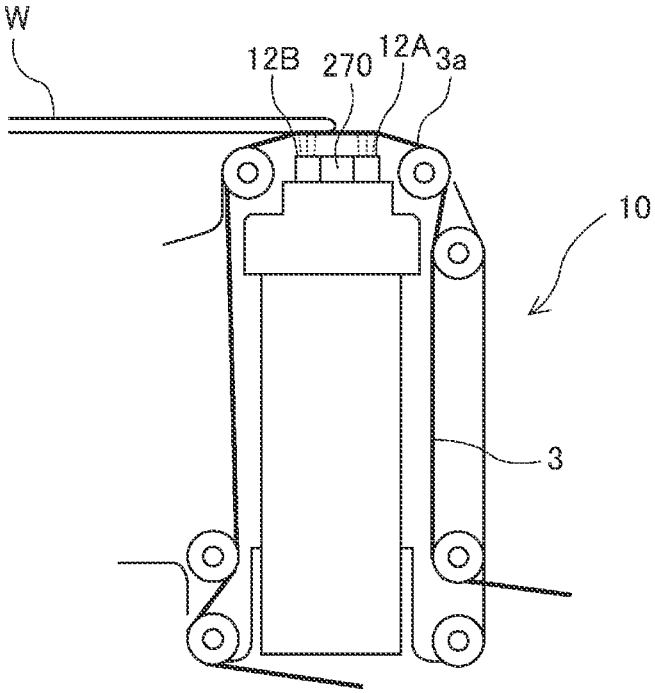
FIG. 18 is a diagram showing the polishing head tilted downward by the tilting mechanism.

The polishing apparatus 200 further includes a not-shown tilting mechanism. The polishing apparatus 200 can polish the periphery of the wafer W while changing a tilt angle of the polishing head 10 by the tilting mechanism. FIG. 17 is a diagram showing the polishing head 10 tilted upward by the tilting mechanism (not shown), and FIG. 18 is a diagram showing the polishing head 10 tilted downward by the tilting mechanism.

As shown in FIG. 17, the fluid pressing structure 12A is located above the periphery of the wafer W and faces the top edge portion when the polishing head 10 is tilted upward. As shown in FIG. 18, the fluid pressing structure 12B is located below the periphery of the wafer W and faces the bottom edge portion when the polishing head 10 is tilted downward. When polishing the top edge portion, the polishing surface 3*a* of the polishing tape 3 is pressed against the top edge portion of the wafer W by the fluid pressing structure 12A while the polishing head 10 is tilted upward. When polishing the bottom edge portion, the polishing surface 3*a* of the polishing tape 3 is pressed against the bottom edge portion of the wafer W by the fluid pressing structure 12B while the polishing head 10 is tilted downward. In one embodiment, the polishing head 10 may include only one of the fluid pressing structure 12A and the fluid pressing structure 12B. For example, when polishing only the top edge portion, the polishing head 10 includes only the fluid pressing structure 12A, and when polishing only the bottom edge portion, the polishing head 10 includes only the fluid pressing structure 12B.

The polishing apparatus 200 includes an operation controller 280 configured to control operations of each component of the polishing apparatus 200. The polishing head 10, the liquid supply valve 33, the gas supply valve 34, the flow-rate controller 35, the flow-rate controller (pressure controller) 36, the substrate holder 210, the lower-side supply nozzle 222, the upper-side supply nozzle 230, the polishing-tape feeding mechanism 242, and the tilting mechanism are electrically connected to the operation controller 280. Operations of the polishing head 10, the liquid supply valve 33, the gas supply valve 34, the flow-rate controller 35, the flow-rate controller (pressure controller) 36, the substrate holder 210, the lower-side supply nozzle 222, the upper-side supply nozzle 230, the polishing-tape feeding mechanism 242, and the tilting mechanism are controlled by the operation controller 280. During polishing, the operation controller 280 instructs the polishing-tape feeding mechanism 242 to operate so as to advance the polishing tape 3 in its longitudinal direction at a predetermined speed while applying a predetermined tension to the polishing tape 3.

The operation controller 280 is composed of at least one computer. The operation controller 280 includes a memory 280*a*, and an arithmetic device 280*b*. The arithmetic device 280*b* includes a CPU (central processing unit) or a GPU (graphic processing unit) configured to perform arithmetic operations according to instructions contained in programs stored in the memory 280*a*. The memory 280*a* includes a main memory (e.g., a random access memory) accessible by the arithmetic device 280*b*, and an auxiliary memory (e.g., a hard disk drive or a solid state drive) storing data and the programs therein.

Figure 19:
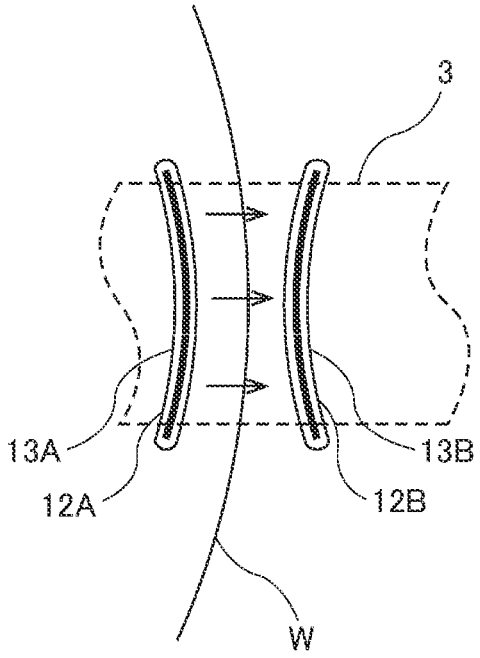
FIG. 19 is a schematic diagram illustrating a top edge portion of a wafer when being polished.

FIG. 19 is a schematic diagram illustrating the top edge portion of the wafer W when being polished. The polishing head 10 is moved by a moving mechanism, which is constituted of a linear actuator (not shown) and other elements, in a direction indicated by arrows shown in FIG. 19 (i.e., outward in the radial direction of wafer W) at a constant speed, while pressing the polishing tape 3 against the wafer W with the fluid. Operations of the moving mechanism are controlled by the operation controller 280. In this embodiment, since the fluid pressing structures 12A and 12B of the polishing head 10 are curved along the periphery of the wafer W, time that the polishing tape 3 is in contact with the wafer W is uniform over the entire top edge portion. Therefore, the entire top edge portion can be uniformly polished. The two fluid pressing structures 12A and 12B and the two fluid supply ports 13A and 13B are curved inwardly toward the center line Ct (see FIG. 16).

The fluid pressing structure 12A and the fluid pressing structure 12B are arranged symmetrically with respect to the center line Ct (see FIG. 16). When the polishing head 10 is tilted downward until the fluid pressing structure 12B faces the bottom edge portion as shown in FIG. 18, the fluid pressing structure 12B extends along the bottom edge portion of the wafer W. Therefore, as well as the top edge portion, the bottom edge portion can be polished accurately and uniformly by the fluid pressing structure 12B.

Figure 20:
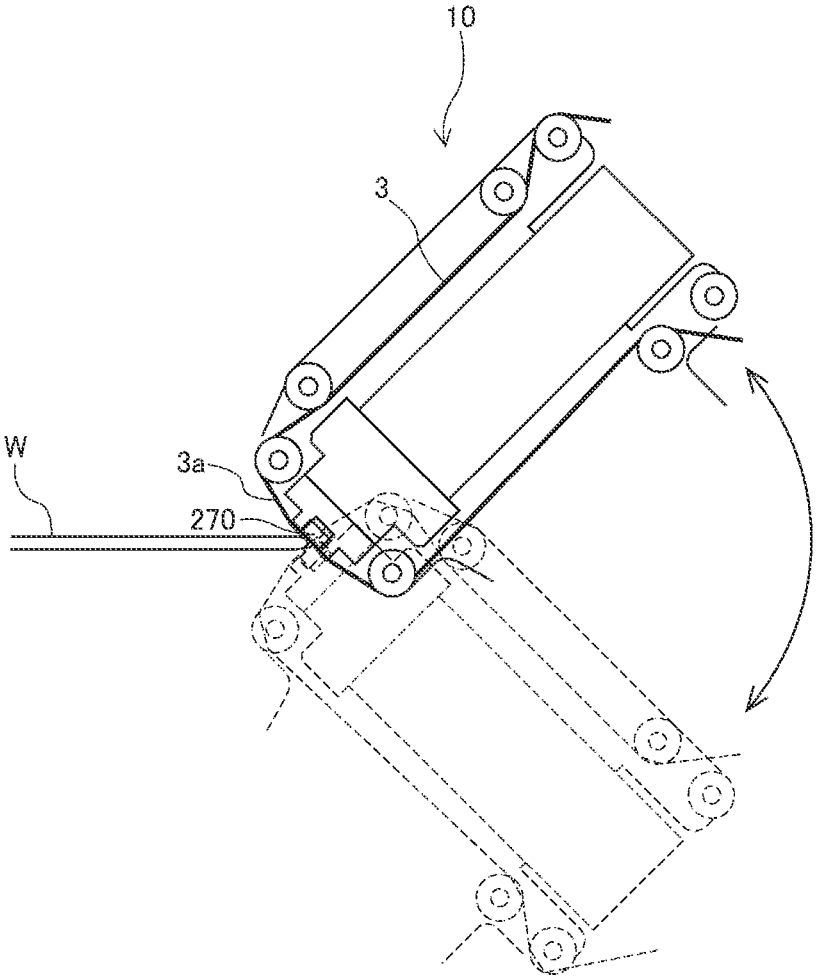
FIG. 20 is a diagram illustrating the polishing head when polishing a bevel portion of the wafer.
Figure 21:
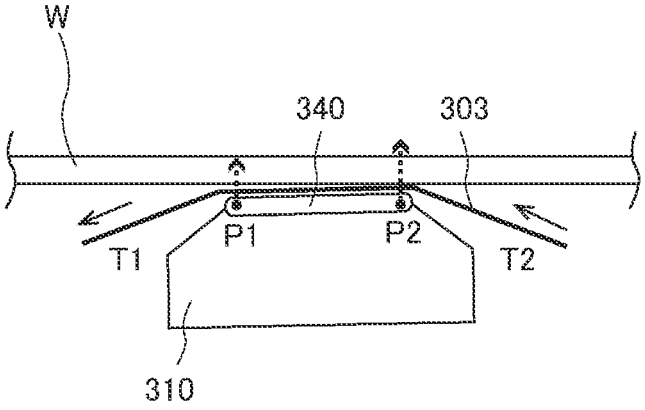
FIG. 21 is a diagram illustrating a problem of a conventional polishing head.

FIG. 20 is a diagram illustrating the polishing head 10 when polishing the bevel portion of the wafer W. When polishing the periphery of the wafer W, the polishing tape 3 is pressed against the periphery (e.g., the bevel portion) of the wafer W by the pressing mechanism (not shown) while the tilt angle of the polishing head 10 is continuously changed by the tilting mechanism (not shown).

In one embodiment, the fluid pressing structures 12A and 12B of the polishing head 10 may include the area pads described with reference to FIGS. 5 to 8, instead of the slit nozzles.

Further, in one embodiment, if the polishing head 10 is intended to polish one of the top edge portion and the bottom edge portion, the polishing head 10 may include only one of the two fluid pressing structures 12A and 12B. Furthermore, in one embodiment, the polishing apparatus 200 may include a plurality of polishing heads 10 arranged in a circumferential direction of the holding stage 204.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

INDUSTRIAL APPLICABILITY

The present invention is applicable to a polishing apparatus and a polishing method for polishing a flat portion of a substrate, such as a wafer.

REFERENCE SIGNS LIST

1 first surface
2 second surface
3 polishing tape
10, 10A, 10B polishing head
11A, 11B polishing-head assembly
12, 12A, 12B fluid pressing structure
13, 13A, 13B fluid supply port
14 flow passage
15 fluid mixing chamber
16, 16A, 16B pressing surface
17, 17A, 17B recess
18, 18A, 18B fluid supply port
30 fluid supply line
31 liquid supply line
32 gas supply line
33 liquid supply valve
34 gas supply valve
35 flow-rate controller
36 flow-rate controller (pressure controller)
37 flow meter
38 flow meter (pressure gauge)
100 polishing apparatus
110 substrate holder
111 roller
120 movable plate
127 rinsing-liquid supply nozzle
128 protective-liquid supply nozzle
131, 131A, 131B supporting member
141, 141A, 141B polishing-tape feeding mechanism
142 reel base
143 tape feeding reel
143*a* tension motor
144 tape take-up reel
144*a* tension motor
153*a*, 153*b*, 153*c*, 153*d*, 163*a*, 163*b*, 163*c*, 163*d*, 173*a*, 173*b*, 173*c*, 173*d* guide roller
180 operation controller
180*a* memory
180*b* arithmetic device
191 polishing-head moving mechanism
193 ball-screw mechanism
193*a* screw shaft
194 motor
195 linear-motion guide
197 mounting surface
200 polishing apparatus
204 holding stage
205 shaft
207 holding-stage driving mechanism
210 substrate holder
214 motor
217 air cylinder
222 lower-side supply nozzle
230 upper-side supply nozzle
242 polishing-tape feeding mechanism
243 tape feeding reel
244 tape take-up reel
245, 246, 247, 248 guide roller
253, 254, 255, 256, 257, 258, 259 guide roller
260 partition wall
265 base plate
270 pressing pad
280 operation controller

The invention claimed is:

1. A polishing apparatus for polishing a flat portion of a substrate, comprising:
- a substrate holder configured to hold a substrate and rotate the substrate;
- a polishing-tape feeding mechanism configured to advance a polishing tape in its longitudinal direction; and
- at least one polishing head arranged near a flat portion of the substrate,
- wherein the polishing head has a fluid pressing structure configured to press the polishing tape with fluid against the flat portion of the substrate,
- the fluid pressing structure has a fluid supply port arranged so as to face a back surface of the polishing tape, and
- the fluid supply port extends obliquely with respect to an advancing direction of the polishing tape as viewed from above the fluid supply port.

2. The polishing apparatus according to claim 1, wherein the fluid pressing structure comprises a slit nozzle having the fluid supply port in a slit shape.

3. The polishing apparatus according to claim 1, wherein the fluid pressing structure comprises an area pad having a pressing surface and the fluid supply port, the pressing surface having a recess formed in the center of the pressing surface, and the fluid supply port being located in the recess.

4. The polishing apparatus according to claim 1, further comprising:
- a liquid supply line coupled to the polishing head; and
- a gas supply line coupled to the polishing head,
- wherein the polishing head has a fluid mixing chamber communicating with the fluid supply port, and
  - the liquid supply line and the gas supply line communicate with the fluid mixing chamber.

5. The polishing apparatus according to claim 4, further comprising:
- a first flow-rate controller coupled to the liquid supply line;
- a second flow-rate controller coupled to the gas supply line; and
- an operation controller configured to control operations of the first flow-rate controller and the second flow-rate controller such that a proportion of a gas in a fluid mixture in the fluid mixing chamber is higher than a proportion of a liquid in the fluid mixture.

6. The polishing apparatus according to claim 1, wherein the flat portion of the substrate comprises an edge portion located in a periphery of the substrate, and the fluid pressing structure has an arc shape having a curvature substantially the same as a curvature of a peripheral shape of the substrate.

7. A polishing method for polishing a flat portion of a substrate, comprising:

holding a substrate and rotating the substrate by a substrate holder; and advancing a polishing tape in its longitudinal direction by a polishing-tape feeding mechanism, while pressing the polishing tape with fluid against a flat portion of the substrate by supplying the fluid from a fluid supply port formed in a fluid pressing structure of a polishing head toward a back surface of the polishing tape, the fluid supply port extending obliquely with respect to an advancing direction of the polishing tape as viewed from above the fluid supply port.

8. The polishing method according to claim 7, wherein the fluid pressing structure comprises a slit nozzle having the fluid supply port in a slit shape.

9. The polishing method according to claim 7, wherein the fluid pressing structure comprises an area pad having a pressing surface and the fluid supply port, the pressing surface having a recess formed in the center of the pressing surface, and the fluid supply port being located in the recess.

10. The polishing method according to claim 7, wherein the fluid comprises a fluid mixture of gas and liquid.

11. The polishing method according to claim 10, wherein a proportion of the gas in the fluid mixture is higher than a proportion of the liquid in the fluid mixture.

12. The polishing method according to claim 7, wherein the flat portion of the substrate comprises an edge portion located in a periphery of the substrate, and the fluid pressing structure has an arc shape having a curvature substantially the same as a curvature of a peripheral shape of the substrate.

13. A polishing apparatus for polishing a flat portion of a substrate, comprising:

a substrate holder configured to hold a substrate and rotate the substrate;

a polishing-tape feeding mechanism configured to advance a polishing tape in its longitudinal direction;

at least one polishing head having a fluid pressing structure arranged near a flat portion of the substrate, the polishing head having a fluid mixing chamber formed therein;

a liquid supply line coupled to the fluid mixing chamber; and a gas supply line coupled to the fluid mixing chamber, wherein the fluid pressing structure has a fluid supply port communicating with the fluid mixing chamber, and the fluid supply port is arranged so as to face a back surface of the polishing tape.

14. The polishing apparatus according to claim 13, further comprising:

a first flow-rate controller coupled to the liquid supply line; and a second flow-rate controller coupled to the gas supply line.

15. The polishing apparatus according to claim 14, further comprising an operation controller configured to control operations of the first flow-rate controller and the second flow-rate controller such that a proportion of a gas in a fluid mixture in the fluid mixing chamber is higher than a proportion of a liquid in the fluid mixture.

* * * * *